US006996940B2

(12) United States Patent
Beasley

(10) Patent No.: US 6,996,940 B2
(45) Date of Patent: Feb. 14, 2006

(54) MOVABLE WALL MODULE

(76) Inventor: Rex W. Beasley, 249 Windward Ave., Venice, CA (US) 90291

( * ) Notice: Subject to any disclaimer, the term of this patent is extended or adjusted under 35 U.S.C. 154(b) by 0 days.

(21) Appl. No.: 10/721,575

(22) Filed: Nov. 24, 2003

(65) Prior Publication Data

US 2004/0103593 A1 Jun. 3, 2004

Related U.S. Application Data

(63) Continuation-in-part of application No. 10/062,617, filed on Jan. 30, 2002, now abandoned.

(60) Provisional application No. 60/266,410, filed on Feb. 2, 2001.

(51) Int. Cl.
*E04D 1/346* (2006.01)

(52) U.S. Cl. ..... 52/65; 52/236.2; 52/243.1

(58) Field of Classification Search ..... 52/64–65, 52/71, 241–242; 49/125, 127, 130; 160/206, 160/196; 248/349, 188.4; 108/139, 22; 104/43–46, 47, 35, 40, 4; 472/29; 414/223
See application file for complete search history.

(56) References Cited

U.S. PATENT DOCUMENTS 2,764,783 A * 10/1956 Teller ..... 52/65
2,823,425 A 2/1958 Granek
3,078,522 A * 2/1963 Anderson ..... 52/34
3,353,471 A 11/1967 Roberts
3,383,810 A * 5/1968 Oswaldo ..... 52/7
3,388,513 A * 6/1968 Bauer ..... 52/65
3,434,249 A 3/1969 Richey
3,491,496 A 1/1970 Johnston
3,742,932 A 7/1973 Greenspan
4,569,164 A * 2/1986 Dickson ..... 52/64
5,400,550 A 3/1995 Beasley
5,815,987 A 10/1998 Beasley
6,148,568 A * 11/2000 Beasley ..... 52/65

* cited by examiner

*Primary Examiner*—Carl D. Friedman
*Assistant Examiner*—Yvonne M. Horton
(74) *Attorney, Agent, or Firm*—Kelly Lowry & Kelley, LLP

(57) ABSTRACT

A movable wall module is provided for installation into an opening formed in a building wall structure, such as a room divider wall in a commercial or residential building. The wall module comprises a frame sized and shaped for substantially nested placement into the wall opening, and to support different functional and/or aesthetic components on opposite sides thereof. The wall module is adapted for manual or power-driven displacement to selectively orient and changeably these components relative to the rooms. In one preferred form, the movable wall module may support audio and/or video components on one side and a work surface such as a desk on the opposite side. In another form, the wall module is a partial-height wall such as a kitchen countertop segment or island, and is rotatably movable to selectively and changeably position the partial-height wall relative to adjacent indoor and/or outdoor spaces.

36 Claims, 18 Drawing Sheets

FIG. 24
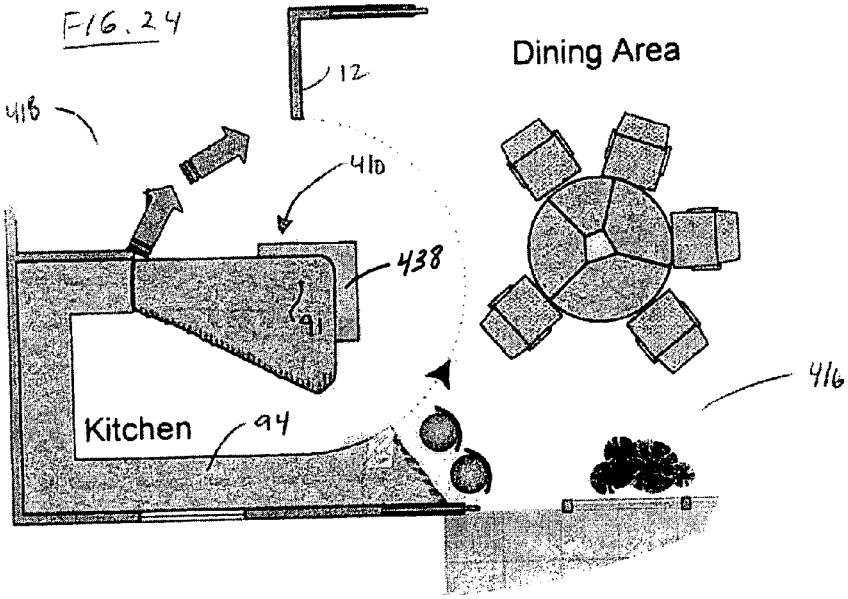
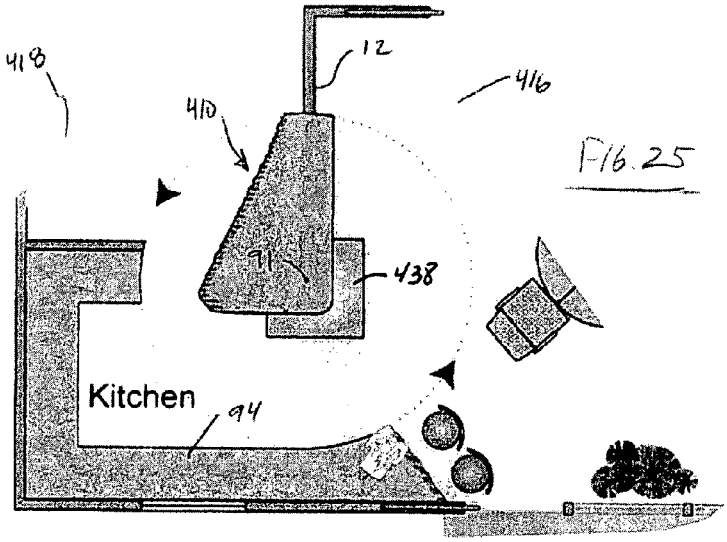
FIG. 25

MOVABLE WALL MODULE

This application is a continuation-in-part of U.S. Ser. No. 10/062,617, filed Jan. 30, 2002 now abandoned, which in turn claims the benefit of U.S. Provisional Application No. 60/266,410, filed Feb. 2, 2001.

BACKGROUND OF THE INVENTION

This invention relates generally to movable wall modules of the type adapted for installation into a building structure, and to support different functional and/or aesthetic components on opposite sides thereof. The movable wall module is designed for selective displacement to variably position the functional and/or aesthetic components within building rooms located on opposite sides of the wall module.

The general concept of movable wall modules is known in the art in the form of a rotatable panel mounted within an opening formed in a building wall which typically separates a pair of rooms located on opposite sides of the building wall, and wherein the rotatable panel is faced on opposite sides with functional and/or aesthetic components designed respectively to match of complement the decor and/or functional use of the two rooms. This concept is frequently depicted in motion picture productions in the form of a hidden or secret passage between the otherwise separated rooms. In this regard, such movable wall modules are normally constructed as part of a stage set, and thus comprise a relatively lightweight and minimal duty cycle structure coupled with appropriate special effects to provide a realistic-appearing and seemingly functional hidden rotatable panel. Conversely, these movable wall modules have not been designed for and have not been compatible with regular daily usage in a modern residential or commercial building environment.

The present invention is directed to an improved and practical movable wall module designed for relatively simple and cost-efficient incorporation into a residential or commercial building. The improved movable wall module supports functional and/or aesthetic components on opposite sides thereof positioned respectively within a pair of rooms, and the wall module can be selectively positioned to reverse the functional and/or aesthetic components thereon relative to the adjacent rooms thereby enhancing the overall utility and versatility of the rooms in a custom-selected manner controlled by the building occupants. Importantly, the movable wall module has a construction that is compatible with modern building structures and building codes to accommodate quick and easy installation into a new or existing building, without requiring extensive or costly structural or electrical or other building modifications.

SUMMARY OF THE INVENTION

In accordance with the invention, an improved movable wall module is provided for installation into a new or existing building structure. The improved wall module carries functional and/or aesthetic components on opposite sides for respective positioning relative to adjacent indoor and/or outdoor spaces associated with the building structure. When desired, the wall module is movable as by rotation to shift the module position and thereby alter the positions of the functional and/or aesthetic components thereon relative to the adjacent spaces or rooms. In one preferred form, the movable wall module is mounted within or along a building wall separating a pair of living or work spaces such as a pair of rooms on opposite sides thereof within the pair of rooms or the like. In another form, the wall module comprises a partial-height structure such as a kitchen countertop segment or island.

In one preferred form of the invention, the movable wall module is mounted within an opening formed in an associated stationary building wall for rotary movement through a displacement of at least about 180° to permit reversal of the functional/aesthetic components thereon relative to the adjacent rooms. The wall module is supported on a relatively broad-based or broad-diameter support bearing assembly anchored on or within the floor. The opposite side edges and a top edge of the wall module are positioned in close proximity with the adjacent side and top edges of the building wall, when the wall module is positioned generally in alignment with the building wall. An expansible acoustic seal may be controllably actuated to seal the narrow space between the wall module and the adjacent building wall. In one alternative form, this narrow space between the wall module and the adjacent building wall may be defined by an elongated and preferably nonlinear gap which may be lined with acoustic, sound-absorbing material. The wall module can be manually rotated or power-driven for movement between first and second positions substantially aligned with the building wall, with the functional/aesthetic components thereon reversibly positioned with respect to the adjacent rooms. The wall module can also be rotated to a position substantially mid-way between the first and second positions to define an open passageway between the adjacent rooms.

In accordance with a further preferred form of the invention, the movable wall module supports electronic components on one or both sides thereof, and further includes appropriate power and/or signal cables for connection to these electronic components. In such embodiment, these power and/or signal cables are conveniently coupled from a stationary site within the building to the wall module by threaded passage through an access port formed in a central portion of the support bearing assembly. Means may be provided to limit rotational displacement of the wall module back-and-forth within a limited range, such as a maximum rotational range of about 360°, to prevent excessive twisting of these power and/or signal cables.

In an embodiment wherein a video display screen such as a flat screen digital display or the like is mounted on one side of the movable wall module, such video display screen may be mounted onto a rotatable subpanel adapted for rotation independently of the wall module. With this construction, the video display screen can be reversibly positioned relative to the wall module for viewing from either one of the adjacent rooms, without requiring reversible positioning of the entire wall module.

In accordance with a further alternative embodiment of the invention, the movable wall panel may comprise a portable unit supported on castors or the like. In this version, the movable wall module may be used as a free-standing display, e.g., in a conferencing environment or the like, in addition to placement into an opening in a building wall for reversible positioning relative to adjacent rooms on opposite sides thereof.

In a further alternative preferred form of the invention, the wall module may comprises a partial-height structure such as a kitchen countertop segment or island, supported for rotary displacement relative to adjacent building spaces. Such structure may be supported for rotation on an axis which is offset relative to a transverse centerline of the rotary structure, thereby altering the size and location of unoccupied space adjacent thereto as the structure is rotated from one position to another. In addition, when the wall module is mounted within a building wall opening, the rotary structure may be supported for rotation on an axis which is offset or out-of-line with the plane of the building wall.

Other features and advantages of the invention will become more apparent from the following detailed description, taken in conjunction with the accompanying drawings which illustrate, by way of example, the principles of the invention.

BRIEF DESCRIPTION OF THE DRAWINGS

The accompanying drawings illustrate the invention. In such drawings:

FIG. 24 is a schematic plan view diagram illustrating another alternative preferred form of the invention, with a rotatably supported partial-height wall module such as a countertop return segment for a kitchen or the like movable to multiple different functional positions relative to adjacent structures and spaces, and with said countertop return segment shown in a first rotary position;

FIG. 25 is a schematic plan view diagram corresponding to FIG. 25, and showing the rotatable countertop return segment in a second rotary position;

DETAILED DESCRIPTION OF THE PREFERRED EMBODIMENTS

Figure 1:
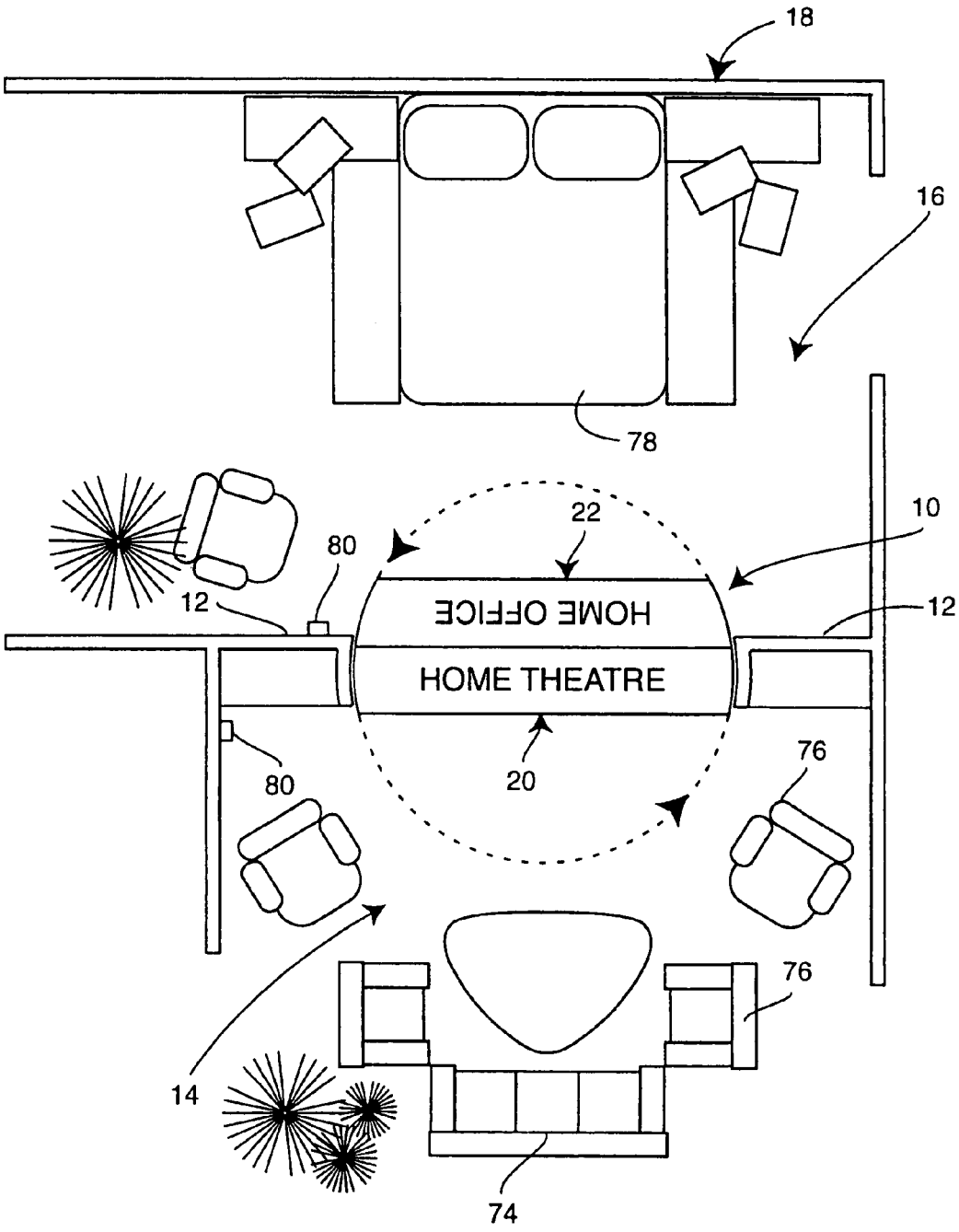
FIG. 1 is a schematic diagram showing the interior of a building, with a movable wall module constructed in accordance with the present invention depicted in a first position.

As shown in the exemplary drawings, an improved movable wall module referred to generally by the reference numeral 10 is positioned along a divider wall 12 separating a pair of rooms 14 and 16 in a building 18. The movable wall module 10 carries functional and/or aesthetic components such as the illustrative home theater 20 and home office 22 on opposite sides thereof for respective positioning within the pair of rooms such as a living room 14 or the like and a bedroom 16 or the like in a residential building, as viewed in FIGS. 1 through 4, or alternately within a pair of rooms in a commercial building. The wall module 10 is designed for displacement as by rotation between a first position with the theater components 20 positioned within the first room 14 and the office components 22 positioned within the second room 16, as viewed in FIG. 1, and a second position with the theater and office components 20, 22 reversed relative to the rooms 14, 16 as viewed in FIG. 4. The wall module 10 may also be displaced to an intermediate or partially rotated position as viewed in FIG. 3 to define an open passageway 24 between the two rooms 14, 16.

FIGS. 1–4 depict the movable wall module 10 of the present invention in a residential dwelling environment, with the illustrative theater and office components 20, 22 for selective and variable positioning within the living room 14 and bedroom 16. However, it will be recognized and understood by persons skilled in the art that the invention may be employed along a building wall structure between other selected specific rooms or living spaces within the interior of a residential or commercial building, and also including installation into an exterior wall between a selected room and an exterior living or work space. The theater components 20 may comprise a television or other selected video monitor or display screen 26 (FIGS. 12–15), particularly such as a flat screen digital video display, together with suitable tuning, video recording and playback, and/or other selected audio components. The office components 22 may comprise a work surface unit such as a desk 27 and/or bookcase or shelving structure (FIGS. 8–9, 11–12 and 14) adapted to support selected office equipment items including but not limited to a computer and related accessories. While the invention is shown and described with respect to the illustrative theater and office components 20, 22, it will be recognized and understood by persons skilled in the art that a wide variety of selected functional and/or aesthetic components may be carried on opposite sides of the wall module 10, such as a service bar, artwork, fireplace, waterfall feature, and the like, or other work surface such as a kitchen countertop or countertop segment, and the like, and further that such components may be removably installed and interchanged in a modular fashion from time to time as desired.

As shown in FIGS. 5–7 and 10, the movable wall module 10 comprises a skeletal frame 28 formed from metal bars or rails to define a relatively lightweight and substantially hollow wall structure. More specifically, this skeletal frame includes a pair of lower support rails 30 extending generally in parallel and horizontally across a lower end of the wall module, with their opposite ends coupled to a corresponding pair of upstanding and generally parallel side rails 32. A short spacer bar 34 is coupled between the associated ends of the lower rails 30 and the lower ends of the side rails 32 to provide a rigid frame structure. The upper ends of the side rails 32 are coupled in turn to a corresponding pair of generally parallel and horizontally extending top rails 36. Additional spacer bars 34 are coupled between the upper ends of the side rails 32 and the associated ends of the top rails 36 to maintain frame rigidity in a lightweight structure.

This skeletal frame 28 provides a convenient system-type substrate adapted to receive and support the various functional and/or aesthetic components as described above, to yield a customized, modular, and subsequently variable or interchangeable installation as selected by an individual customer. The skeletal frame 28 thus facilitates quantity production of the movable wall module 10 with selected customized features, and further wherein such features can be provided in modular form for quick and easy assembly with the frame 28 as well as subsequent post-installation modification as may be desired by the customer.

A main support bearing assembly 38 is secured to a central region of the lower support rails 30 of the wall module frame 28. As shown best in FIGS. 6 and 7, this support bearing assembly comprises a generally rectangular bearing plate 40 secured by brackets 42 or the like to the underside of the lower support rails 30. This bearing plate 40 is secured in turn by a plurality of mounting bolts 44 in a ring pattern to an upper ring segment 46 of a relatively broad-based or wide diameter bearing unit 48. With this arrangement, the load of the rails 30 is transferred to the support brackets 42, while providing at least some spacing between the rails and the underlying bearing plate 40 and associated mounting bolts 44. The mounting bolts 44 can be tightened in varying degrees to evenly distribute the load across the bearing plate 40. The bearing unit 48 further includes bearing balls 50 or the like interposed between the upper ring segment 46 and a corresponding lower ring segment 52 which rests upon and may be suitably attached to the building floor 54. In one preferred geometry, the bearing unit 48 has a cross sectional size of about 2 feet, and the depth of the frame 28 as defined by the lengths of the spacer bars 34 ranging from about ½ to about 1½ feet.

With this construction, the support bearing assembly 38 provides broad-based and stable rotary support for the movable wall module about a vertically oriented axis corresponding with a centerline of the bearing unit 48. The bearing assembly 38 transmits the module load to a relatively broad floor area having a width or diametric size greater than the thickness of the wall module 10. Other bearing structure forms will be recognized by persons skilled in the art, and may be used for rotatably supporting the wall module 10 in a manner distributing the module load over a relatively broad area to the underlying building floor 54. If desired, additional bearing support means may be provided between the upper end of the frame and the ceiling or the like of the building.

Figure 8:
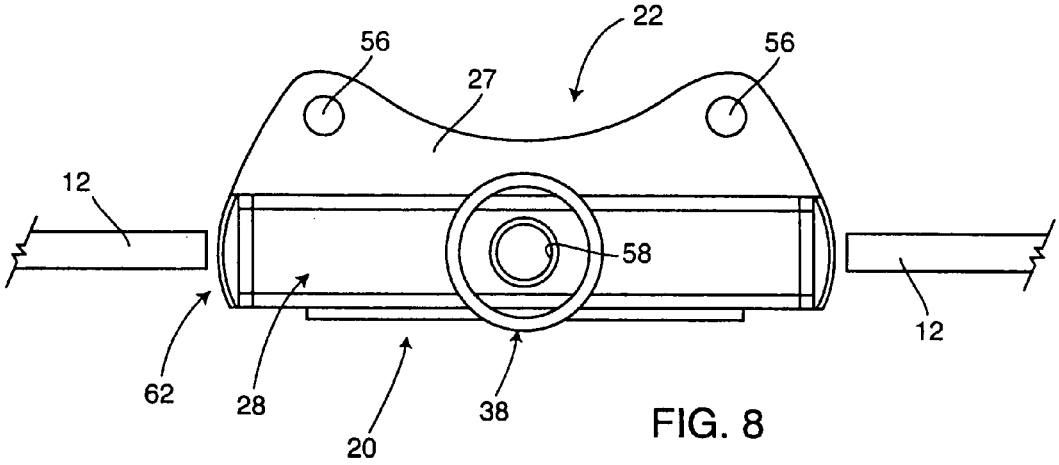
FIG. 8 is a schematic plan view diagram showing installation of the movable wall module within an open gap formed in the wall structure of a building.
Figure 9:
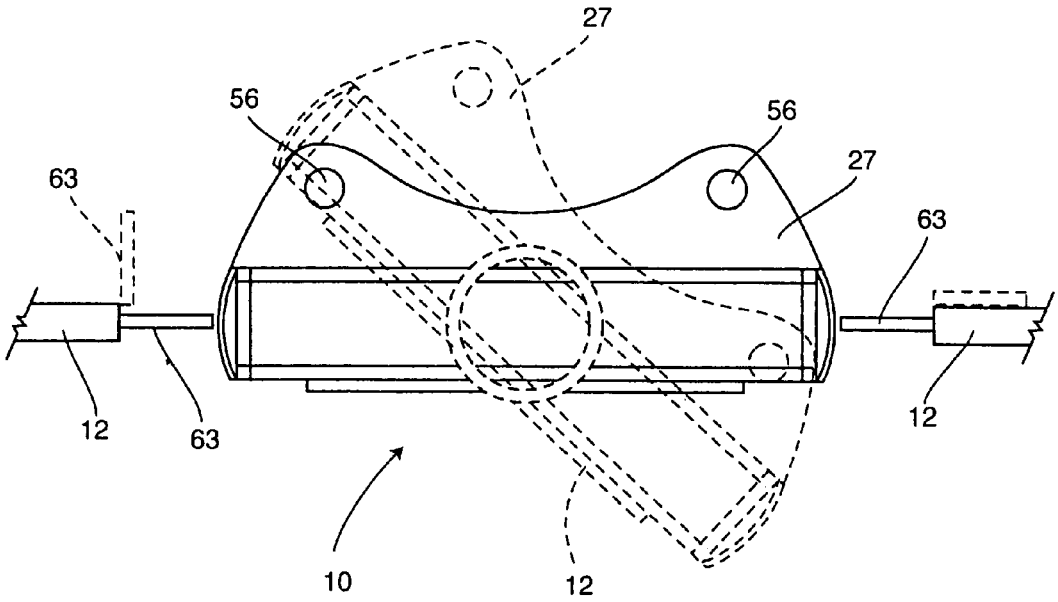
FIG. 9 is a schematic plan view diagram similar to FIG. 8, wherein the movable wall module is mounted within an opening formed in a building wall structure between a pair of doors.
Figure 12:
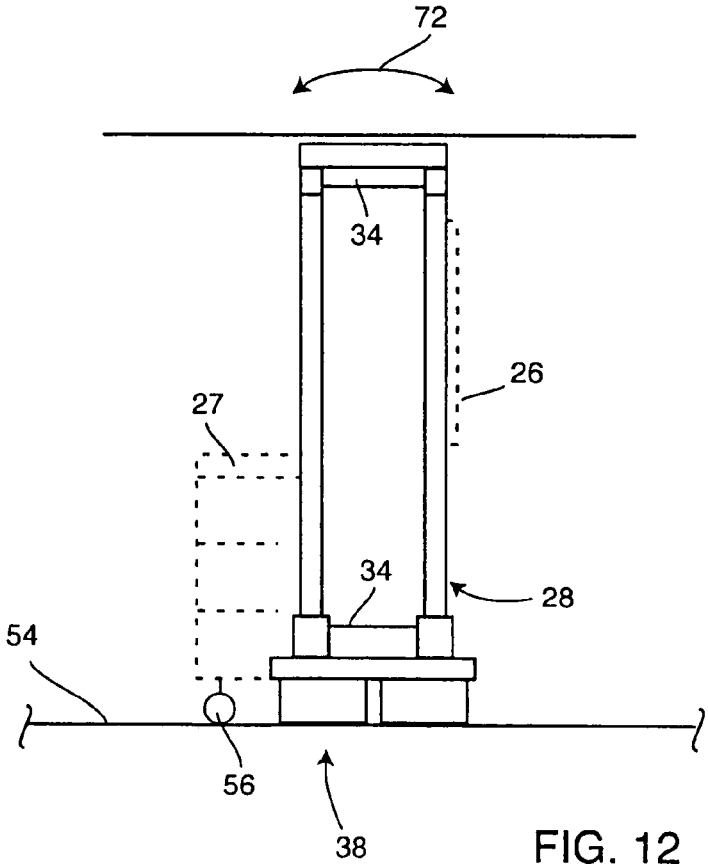
FIG. 12 is a vertical sectional view taken generally on the line 12—12 of FIG. 5.

The functional and/or aesthetic components such as the theater and office components 20, 22 are mounted, preferably removably, onto the frame 28 on opposite sides thereof to face respectively into the adjacent pair of rooms 14, 16 when the movable wall module 10 is aligned generally with the adjoining divider wall 12. FIGS. 8–9 and 12 illustrate the theater components 20 to include at least a flat surface video display screen, and the office components 22 to include the desk structure 27 or other generally horizontally oriented work surface or transaction surface such as a countertop, incorporating a pair of spaced-apart castors 56 spaced outwardly from the frame 28. With this construction, the desk-supporting castors 56 cooperate with the frame support bearing assembly 38 to provide an increased overall support base or footprint of the wall module 10 with three-point support for enhanced stability. An access port 58 (FIG. 6) is conveniently formed in the underlying bearing plate 40 for accommodating upward passage of utility service components such as one or more flexible cables 60, i.e., power cables, telephone wires, coaxial cables for transmitting video and/or audio signals and/or for broad band internet access, or for computer network connections.

Figure 10:
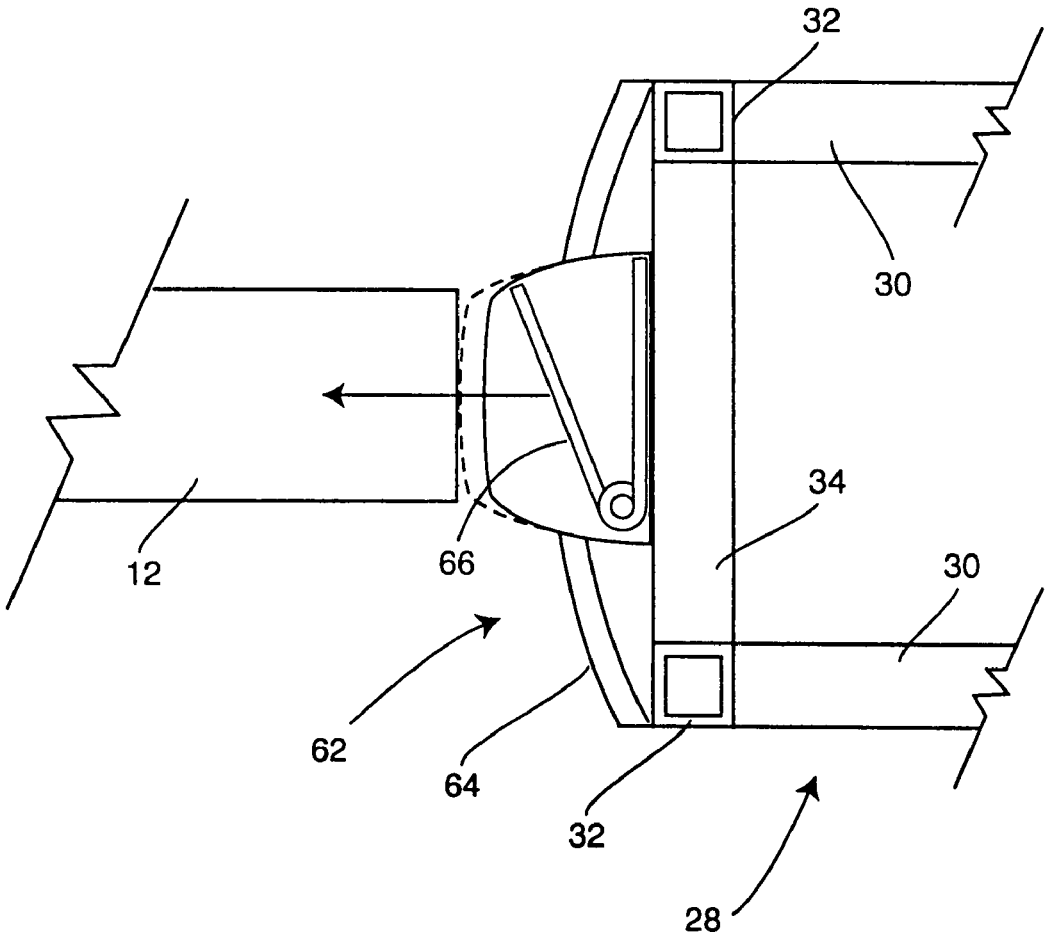
FIG. 10 is an enlarged fragmented vertical sectional view showing an expansible acoustic seal mounted along the side edge of the movable wall module for engaging the adjacent side edge of the building wall structure.

The overall width and height of the movable wall module 10 is adapted to fit with close clearance into the opening formed in the room divider wall 12. In this regard, the opposite side edges of the module 10 fit in close clearance relation with the adjoining side edge of the divider wall 12, as viewed best in FIG. 10. FIG. 9 shows one alternative arrangement wherein the adjacent side edges of the divider wall 12 carries swinging (or sliding) doors 63 which, in the closed positions, present door side edges in close clearance relation to the opposite side edges of the wall module 10. In either case, a similar close clearance is provided between the top edge of the wall module 10 and an adjoining top edge lining the opening in the divider wall 12, as shown best in FIGS. 12–14. FIG. 10 illustrates an expansible acoustic seal 62 in the form of a resilient diaphragm 64 mounted on the module side edge, in combination with a mechanical actuator lever 66 mounted between the module side edge and the diaphragm 64. The actuator lever 66 is designed to extend against the diaphragm 64 when the wall module 10 is aligned with the divider wall 12, to press the diaphragm against the exposed side edge of the divider wall 12 to provide an effective acoustic and visual seal between the adjacent rooms. Preparatory to rotating the wall module 10 to an alternative position, the actuator lever 66 is retracted to permit wall module rotation with minimal or no resistance. An alternative acoustic and visual seal such as an inflatable bladder may be used, as shown and described in U.S. Pat. No. 5,815,987 which is incorporated by reference herein.

Figure 11:
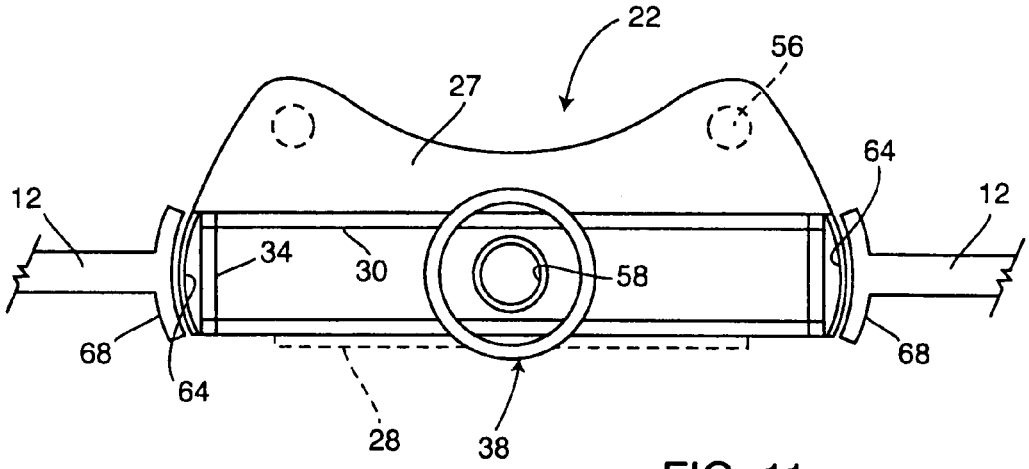
FIG. 11 is a schematic plan view diagram similar to FIG. 8, but illustrating a modified side edge formed on the building wall structure for cooperating with the adjacent side edge of the movable wall module to define an elongated nonlinear acoustic gap therebetween.

FIG. 11 depicts a further alternative acoustic and visual seal geometry for the side edges of the movable wall module 10. In this embodiment, the diaphragm 64 is mounted along the sides edges of the wall module and provides an outwardly convex curved configuration. A generally matingly shaped baffle wall segment 68 is formed on the adjoining side edge of the divider wall 12, so that the diaphragm 64 and baffle wall segment 68 defining a narrow curved or nonlinear passage therebetween which provides an effective acoustic and visual seal. If desired, the external surfaces of the diaphragm 64 and/or the baffle wall segment 68 may be lined with an acoustic or porous sound-absorbing material.

FIG. 12 shows the movable wall module 10 in side elevation, with the top edge of the wall module in closely spaced relation with the ceiling or other top edge lining the opening in the divider wall 12. The depth of the assembled wall module 10 is significantly greater than the clearance spacing between the module top edge and the ceiling, whereby the ceiling surface provides additional support stability to the wall module. That is, any attempt to overturn or tip the wall module 10 over, such as by applying a force in the direction of arrow 72, causes the top edge of the module to move against the ceiling surface which blocks such tip-over displacement.

The assembled wall module 10 is shown in FIG. 1 in a first or primary position with the theater components 20 positioned within the first room 14 which comprises a living room in a residence. The theater components 20 are oriented so that the video display screen and/or other audio/video components are positioned within the room for use and enjoyment by occupants, and in relation to other furniture items such as a sofa 74, and related chairs 76. Conversely, the office components 22 are positioned within the second room 16 which comprises a residence bedroom, in an orientation for substantially private use of these components as a home office, and in relation to other furniture items such as a bed 78. Importantly, the wall module 10 blends smoothly with the associated divider wall 12 to present an attractive and natural appearance while providing an effective acoustic barrier and obstructing visual observation of one room from the other.

Figure 2:
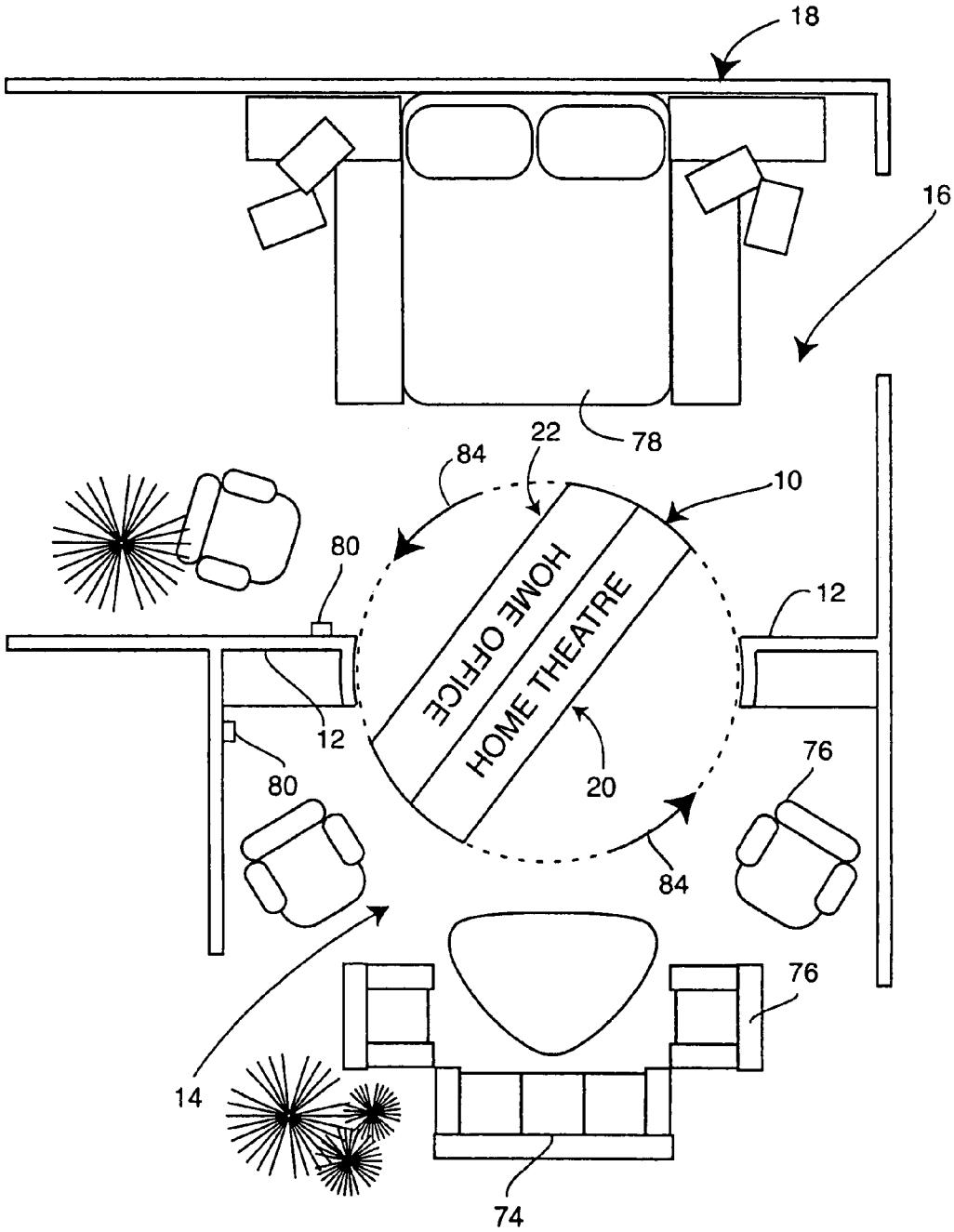
FIG. 2 is a schematic diagram similar to FIG. 1, but showing displacement of the movable wall module from the first position.
Figure 3:
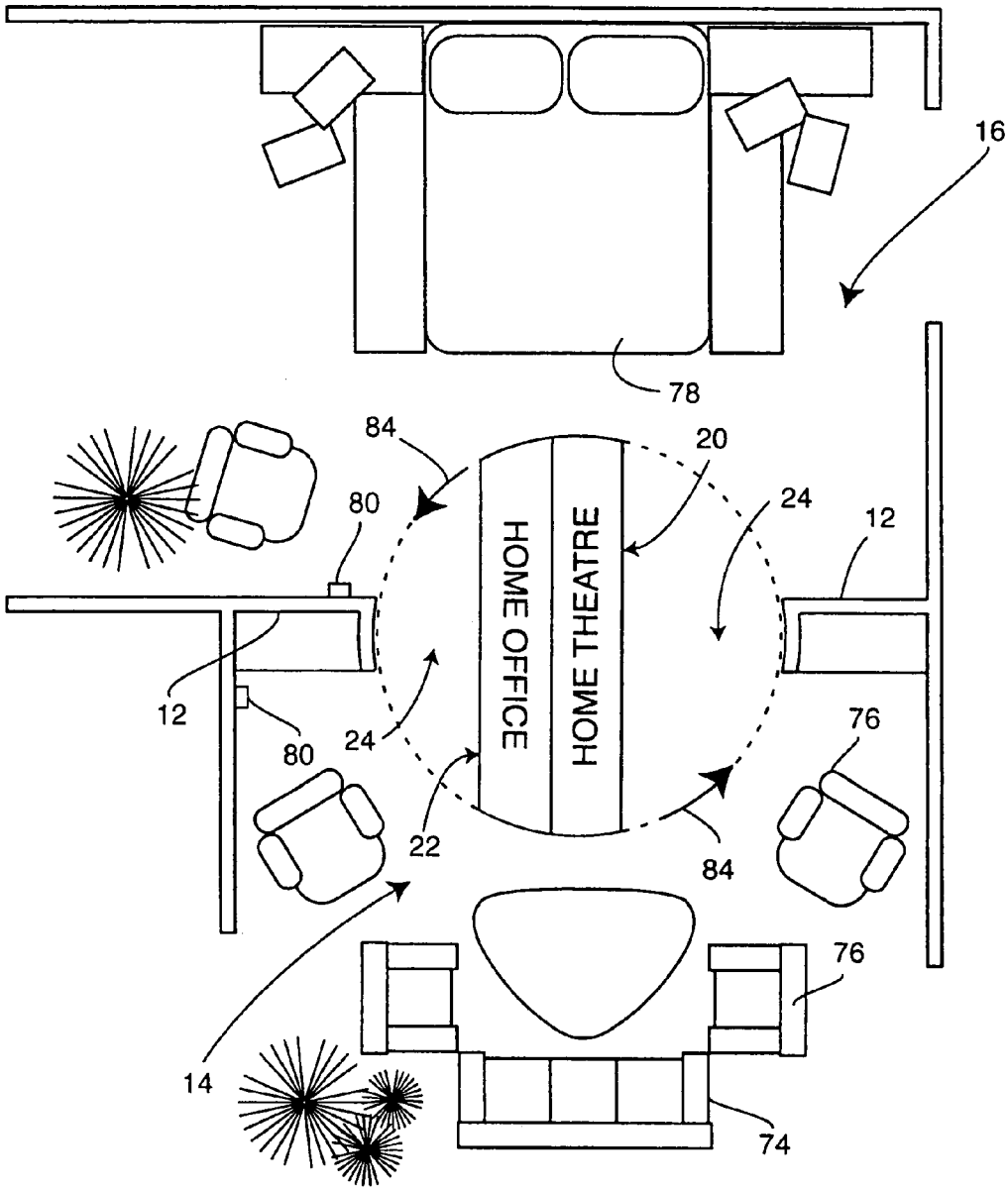
FIG. 3 is a schematic diagram similar to FIGS. 1 and 2, depicting the movable wall module is a substantially full-open position.
Figure 4:
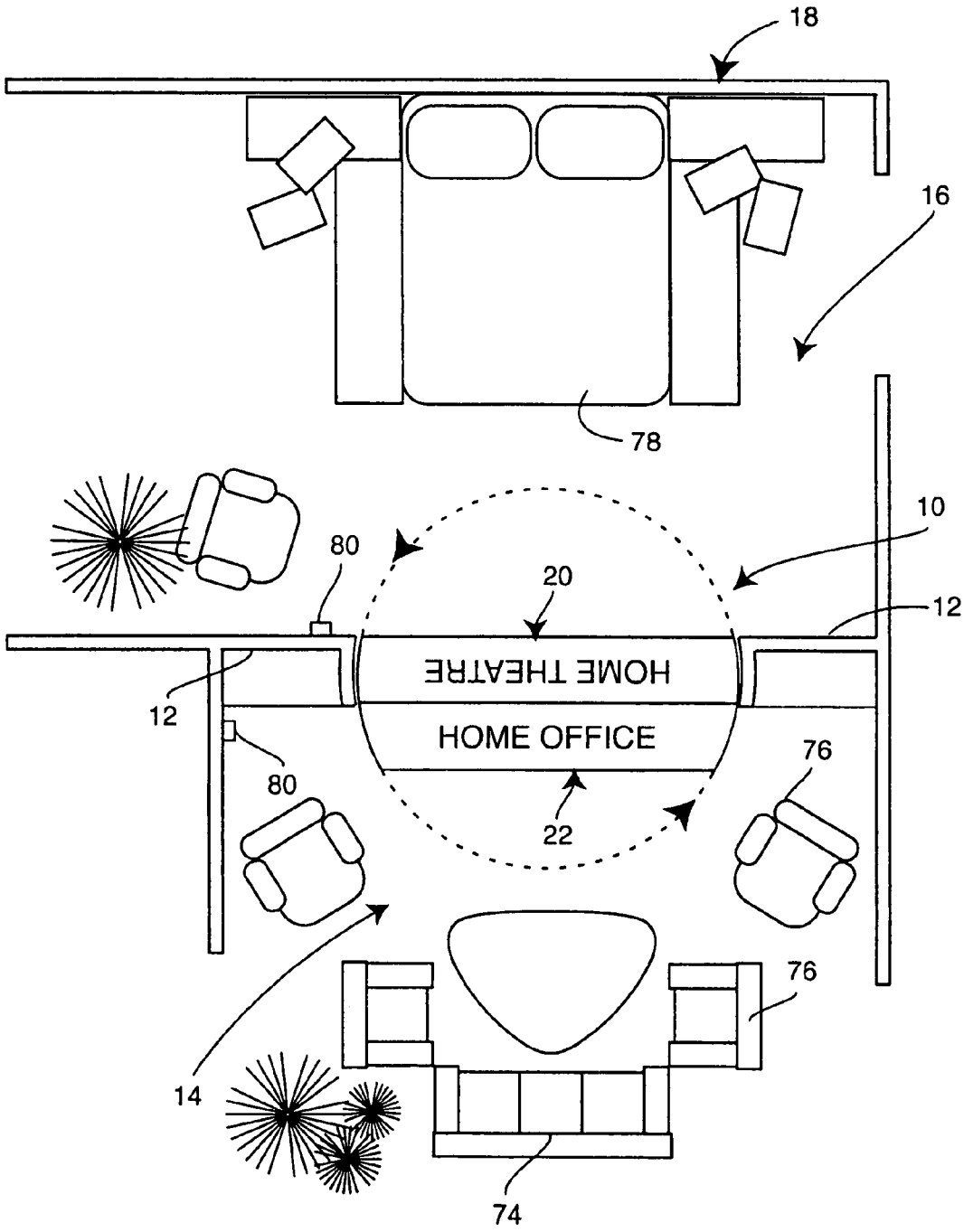
FIG. 4 is a schematic diagram similar to FIGS. 1–3, illustrating the movable wall module in a second position.
Figure 5:
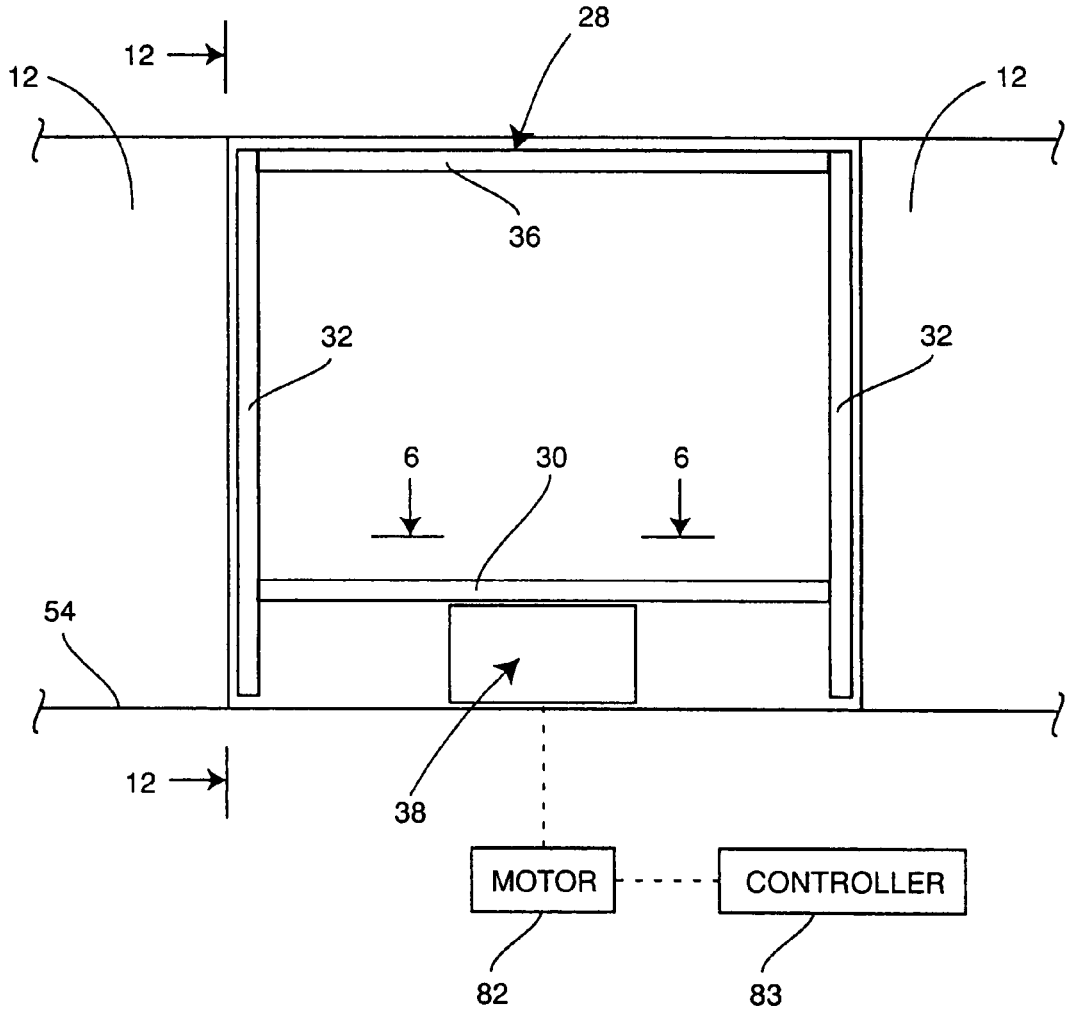
FIG. 5 is a schematic elevation view of one side of the movable wall module, with decorative and exterior functional components removed to illustrate an internal frame and rotatable support bearing assembly.
Figure 6:
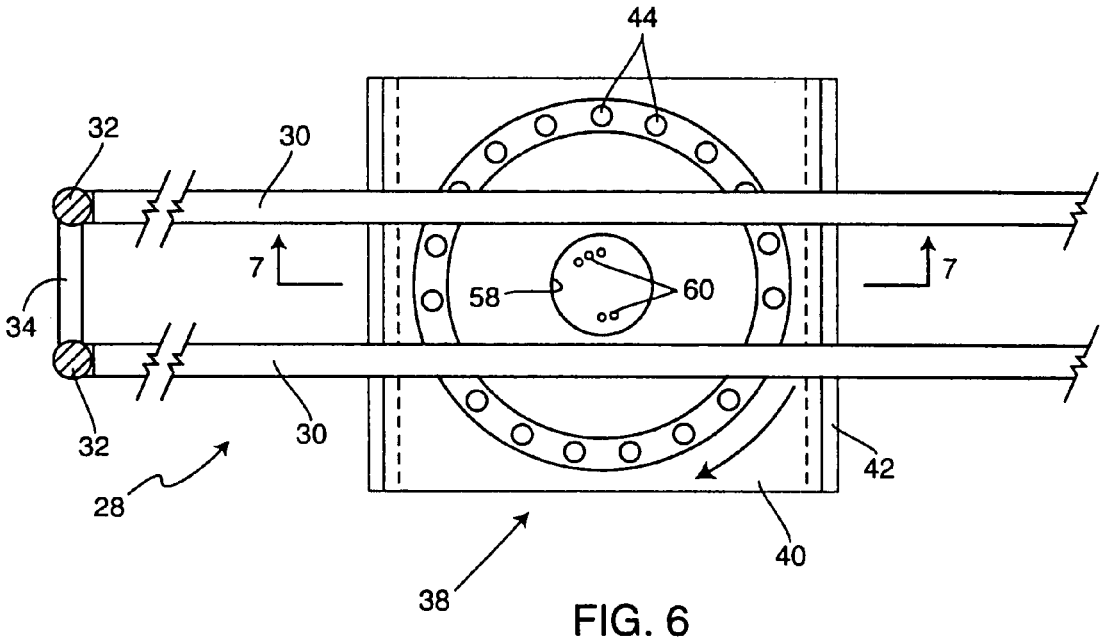
FIG. 6 is an enlarged fragmented horizontal sectional view taken generally on the line 6—6 of FIG. 5.
Figure 7:
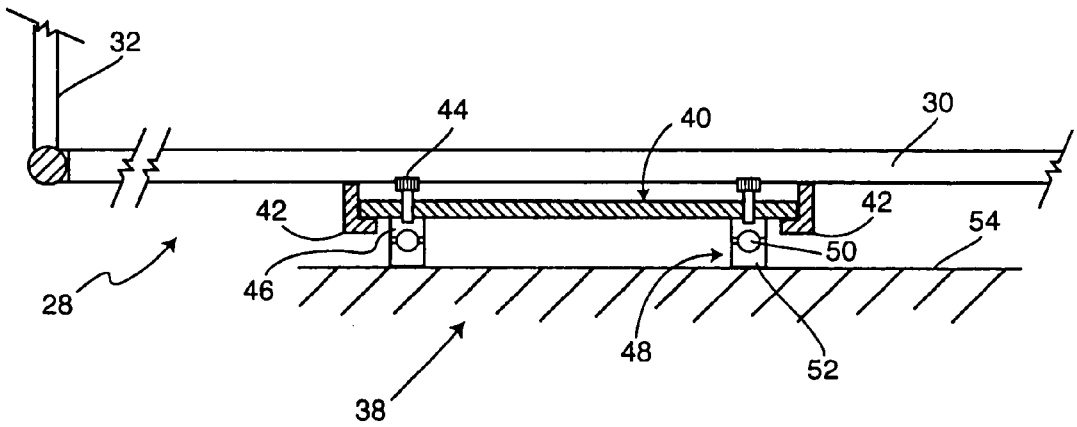
FIG. 7 is a fragmented vertical sectional view taken generally on the line 7—7 of FIG. 6.

In the event that an occupant of the building decides to reverse the position of the movable wall module 10, for virtually any selected period of time, the wall module is rotatable on the bearing assembly 38 quickly and easily from the position shown in FIG. 1 to the reverse position shown in FIG. 4. More particularly, the wall module 10 can be designed for manual rotation, or more preferably for power-driven rotational displacement in response to activation of a wall switch 80 (FIGS. 1–4) or alternately by means of a remote control transmitter (not shown). In the power-driven embodiment, a drive motor 82 (shown schematically in FIG. 5) is energized under regulation by a suitable controller 83 to rotate the wall module 10 for a selected period of time until an alternative position of adjustment is achieved, or through a predetermined rotational increment to achieve the selected alternative position of adjustment. This drive motor 82 may be housed conveniently within the bearing assembly 38 and provided in the form of a compact module adapted to drop in place without requiring construction of an underlying cavity in the building floor. FIG. 2 illustrates rotational displacement of the wall module 10 in a counter-clockwise direction as indicated by arrows 84. FIG. 3 shows the wall module 10 in a position rotated approximately mid-way to the reversed or secondary position, wherein the module 10 cooperates with the adjoining side edges of the divider wall 12 to define a pair of transit openings 24 through which a person may pass from room to room. FIG. 4 shows the wall module in the reversed or secondary position with the theater components 20 positioned in the bedroom 16 and the office or other work surface components 22 positioned within the living room 14. The controller 83 (FIG. 5) is appropriately programmed to retract the expansible acoustic seal 62 prior to wall module rotation to an alternative position, and to re-expand the seal 62 to re-engage the divider wall 12 when the alternative position aligned with the divider wall 12 is reached.

It will also be recognized that the controller 83 (FIG. 5) may be desirably programmed and/or appropriate positional sensors (not shown) provided to preclude over-rotation of the wall module 10 in a manner which could otherwise result in undesirable excess twisting of the power and signal cables coupled to the module through the bearing assembly 38. In this regard, in a preferred form, the controller 83 is designed to permit back-and-forth module rotation through 360° sufficient to accommodate reversible module rotation, and also sufficient to set the video display screen 26 or other functional and/or aesthetic components at virtually any angular orientation relative to either room for optimal viewing, examples of such alternative angular positions being depicted in FIGS. 2 and 3. Alternately, suitable slip ring cable couplings may be used for accommodating unlimited module rotation without cable twisting.

In accordance with one aspect of the invention, the wall module 10 does not include a floor segment or component such as a turntable projecting into either room 14, 16, and thereby does not obstruct, overlie or interrupt the existing floors or floor coverings within these rooms. With this construction, in either rotational position, the wall module 10 presents the appearance of a stationary fixed structure, while avoiding the potentially unattractive appearance temporary connotation of a turntable floor segment projecting outwardly therefrom into the rooms 14, 16. In addition, with this structure, the wall module 10 is adapted for retrofit installation into an existing building, without disrupting existing floors and floor surfaces.

Figure 13:
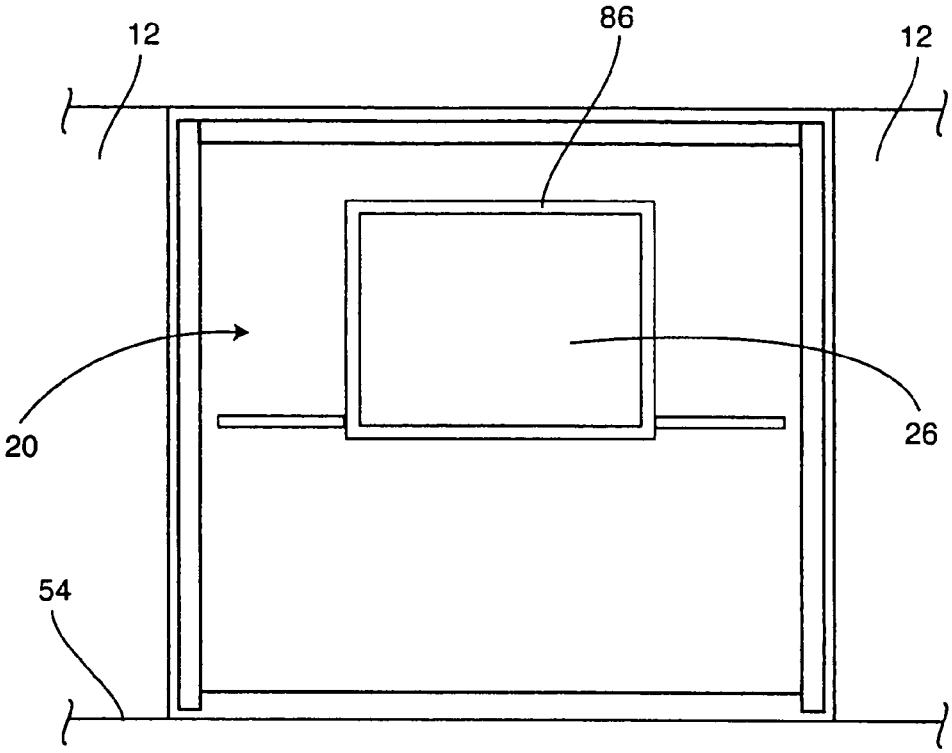
FIG. 13 is an elevation view showing one side of the movable wall module in accordance with one preferred form of the invention, to include a substantially planar video screen mounted on a rotatable subpanel.
Figure 14:
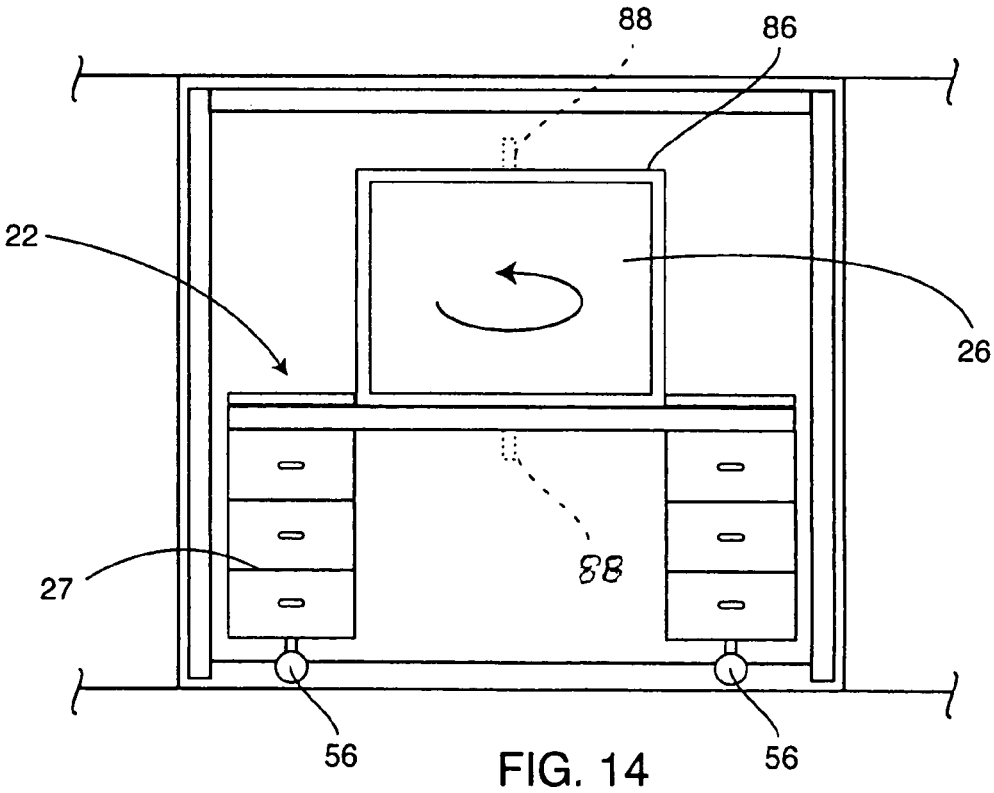
FIG. 14 is an elevation view showing the opposite side of the movable wall module in accordance with the embodiment of FIG. 13, and illustrating rotational movement of the subpanel with video screen thereon separate from movement of the wall module.

FIGS. 13–14 depict an alternative preferred form of the invention, wherein the movable wall module 10 is constructed and operated as previously described herein, but further wherein the video display screen 26 is carried by a rotatable subpanel 86 adapted for rotational positional adjustment independent of the remainder of the wall module. FIG. 13 shows the subpanel 86 rotated to a position with the video display screen 26 positioned for viewing on one side of the movable wall module, surrounded by other decorative and/or functional components such as a decorative waterfall display. FIG. 14 depicts the subpanel 86 rotated to an opposite position for viewing on an opposite side of the wall module 10, in relation to the illustrative office components 27 depicted thereon. The subpanel 86 is rotatably supported on pivot pins or compact bearings 88 (shown in dotted lines in FIG. 14), or alternately upon a compact turntable (not shown), for manual or power-drive rotation as previously described with respect to rotation of the wall module. Suitable power and/or signal cables may also be coupled to the rotatable display screen 26 in the same manner as previously described with respect to the wall module.

Figure 15:
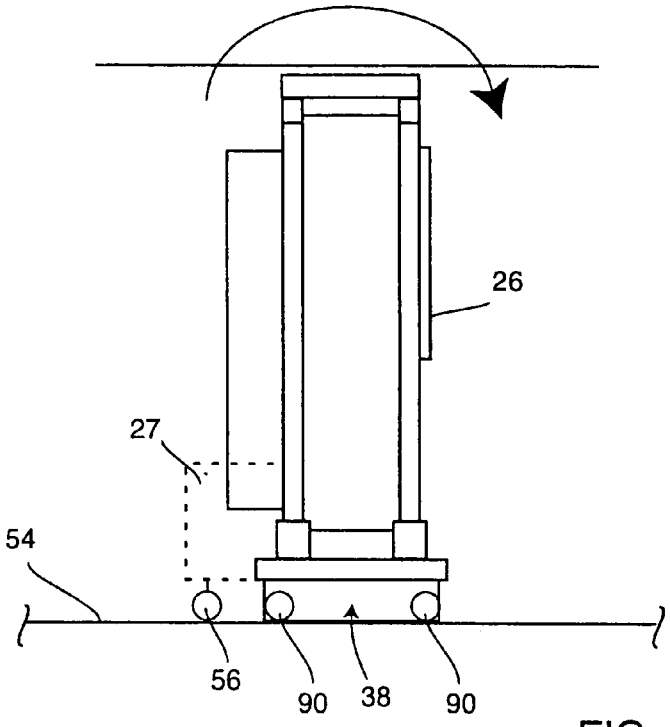
FIG. 15 is a side elevation view similar to FIG. 12, but illustrating the movable wall module in accordance with an alternative preferred form of the invention.

FIG. 15 is a side elevation view of the movable wall module 10 similar to FIG. 12, but further illustrating the main support bearing assembly 38 equipped with castors 90 to accommodate rolling transport of the wall module. In this arrangement, the lower ring segment 52 of the bearing unit 48 is not fixed to the building floor 54. Instead, the lower ring segment 52 carries the castors 90 which permit the wall module 10 to be moved from one place to another in a portable fashion. The wall module 10 can be rolled into an opening within a building divider wall 12 for selective positional adjustment, as previously described, or the wall module can be moved from the divider wall 12 to a more convenient location for viewing of the display screen 26, or for use of the office components, etc.

Figure 16:
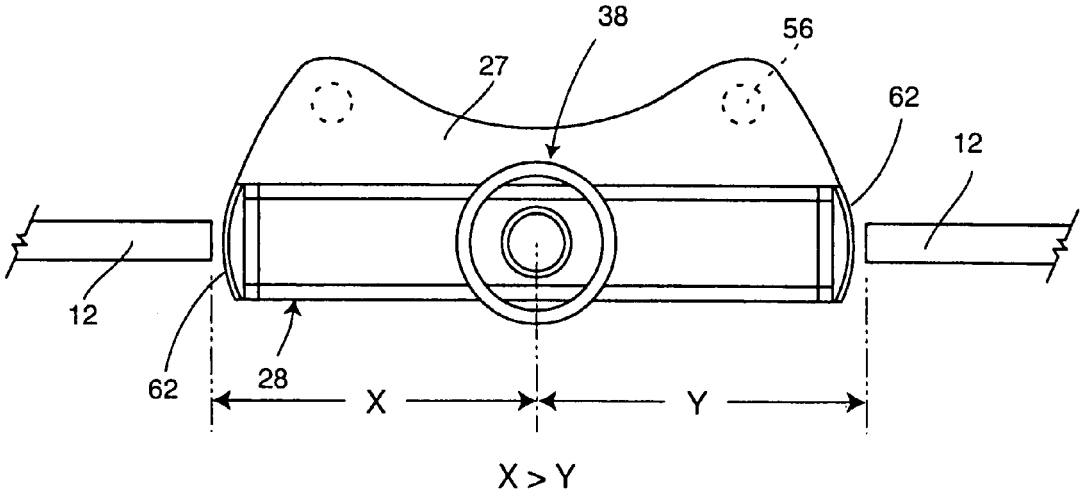
FIG. 16 is a schematic plan view diagram similar to FIG. 8, but depicting the movable wall module in accordance with another alternative preferred form of the invention.

FIG. 16 shows an alternative configuration of the movable wall module 10 adapted for mechanically precluding over-rotation of the wall module in one direction to result in undesirable excessive twisting of power and/or signal cables coupled thereto. In this configuration, the main bearing support assembly 38 is mounted onto the module frame 28 in a laterally off-axis or off-center position that is otherwise disposed generally in-line with the plane of the associated building wall 12. More specifically, the main bearing support assembly 38 is connected to the module so that the distance "x" between the rotatable axis of the bearing unit to one side edge of the module 10 is greater than the distance "y" between said rotatable bearing axis and the opposite side edge of the module 10. This construction prevents rotation of the module 10 beyond 180° in either direction.

Figure 17:
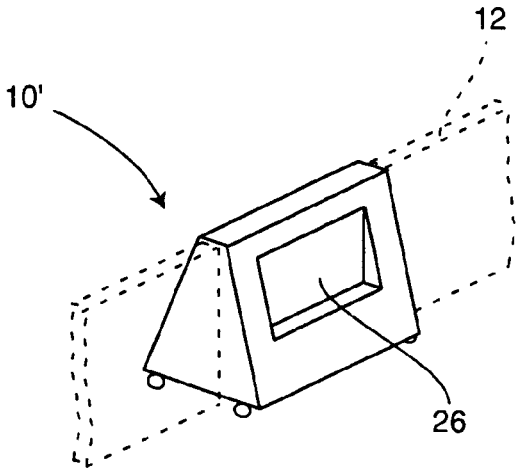
FIG. 17 is a perspective view showing still another alternative preferred form of the movable wall module.
Figure 18:
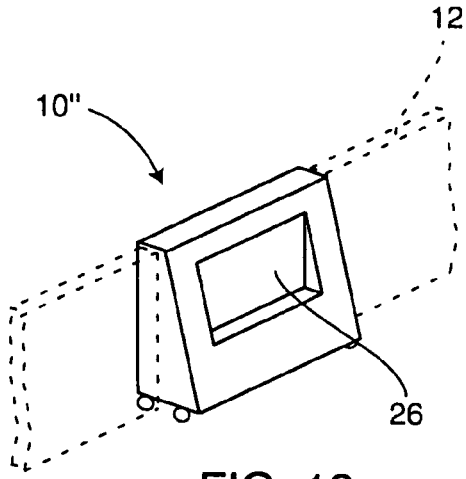
FIG. 18 is a perspective view depicting a further alternative preferred form of the invention.
Figure 19:
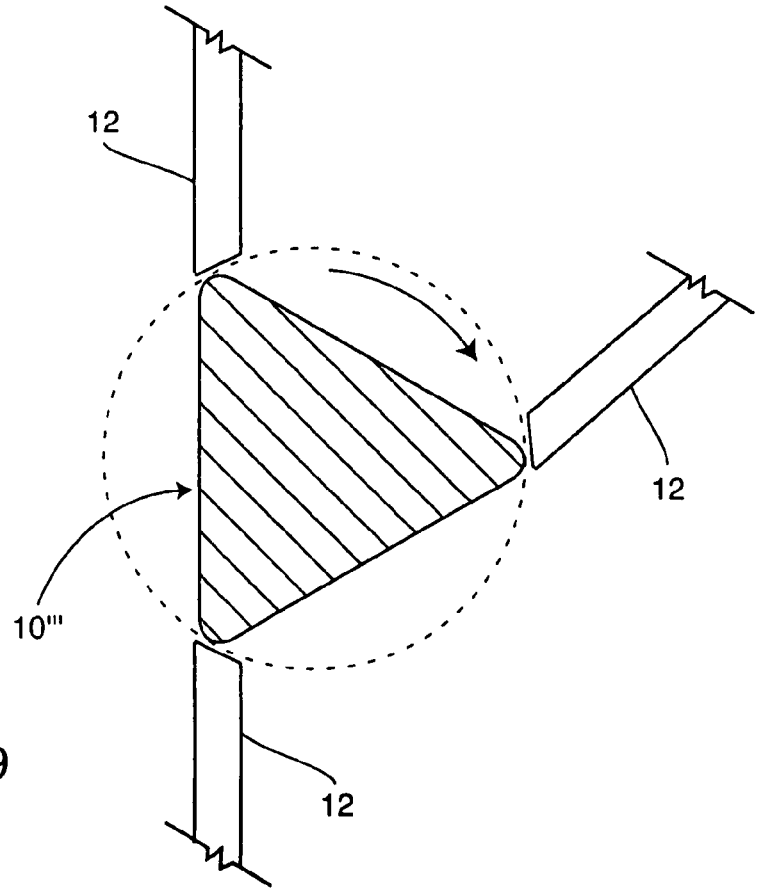
FIG. 19 is a schematic plan view diagram illustrating a three-sided configuration for the movable wall module of the present invention.

Further alternative embodiments of the movable wall module 10 are shown in FIGS. 17–19. FIG. 17 illustrates a portable wall module 10' supported on castors 90 for rolling movement similar to the version shown in FIG. 15, with the exception that the module 10' has a generally truncated triangular cross sectional shape defining a broad base depth and a narrower top depth. FIG. 18 illustrates a similar portable wall module 10" having a generally truncated triangular cross sectional shape with an angled face on one side and a vertically upright face on the opposite side. FIG. 19 is a schematic diagram showing a three-sided embodiment 10'" of the movable wall module for rotatable positioning of three module sides equipped with functional and/or aesthetic components for respective positioning within three adjacent rooms defined by a trio of adjoining divider walls 12.

FIGS. 20–23 depict further alternative preferred embodiments of the invention, wherein components identical to those previously shown and described herein are identified by common reference numerals, and modified components that otherwise correspond in structure and function to those previously shown and described herein are conveniently identified by common reference numerals increased by a factor of 200 or 300. FIGS. 20–23 illustrate a partial-height movable wall module 210 such as a free-standing island or the like for use in a kitchen or similar environment. FIGS. 20–23 also depict a separate movable wall module 310 supported within a building wall 12 for off-axis rotary movement on an off-set axis located out-of-line or laterally spaced at least a short distance from the plane of the building wall 12.

More particularly, the illustrative partial-height wall module 210 is rotatably supported for movement on a rotary axis 92 for variable positioning relative to other structures present in the building space, such as a stationary countertop 94 in a kitchen including traditional kitchen components such as an oven 95, a sink 96, a dishwasher 97, and a refrigerator 98, etc. The movable module 210 as shown has an asymmetric shape in plan view, with a circular central segment 99 merging on one side with an enlarged, generally half-circle lobe or segment 100 supporting for smooth rolling movement on the floor 54 as by means of castors or the like of the type shown in FIG. 12. The central segment 99 is rotatably coupled to the floor 54, as by means of a broad-based bearing assembly as previously shown and described herein. A range top 101 may be carried by the island module 210, with appropriate flexible or rotatable utility service components such as a power cable or and/or gas conduit coupling via a port in the bearing assembly to a suitable electrical or gas power source, also as previously shown and described herein. Alternately, persons skilled in the art will recognize and appreciate that a sink could be installed onto the island module 210, with appropriate flexible or rotatable utility service components including water supply lines and drain lines coupled through the bearing assembly (not shown in FIGS. 20–23).

Figure 20:
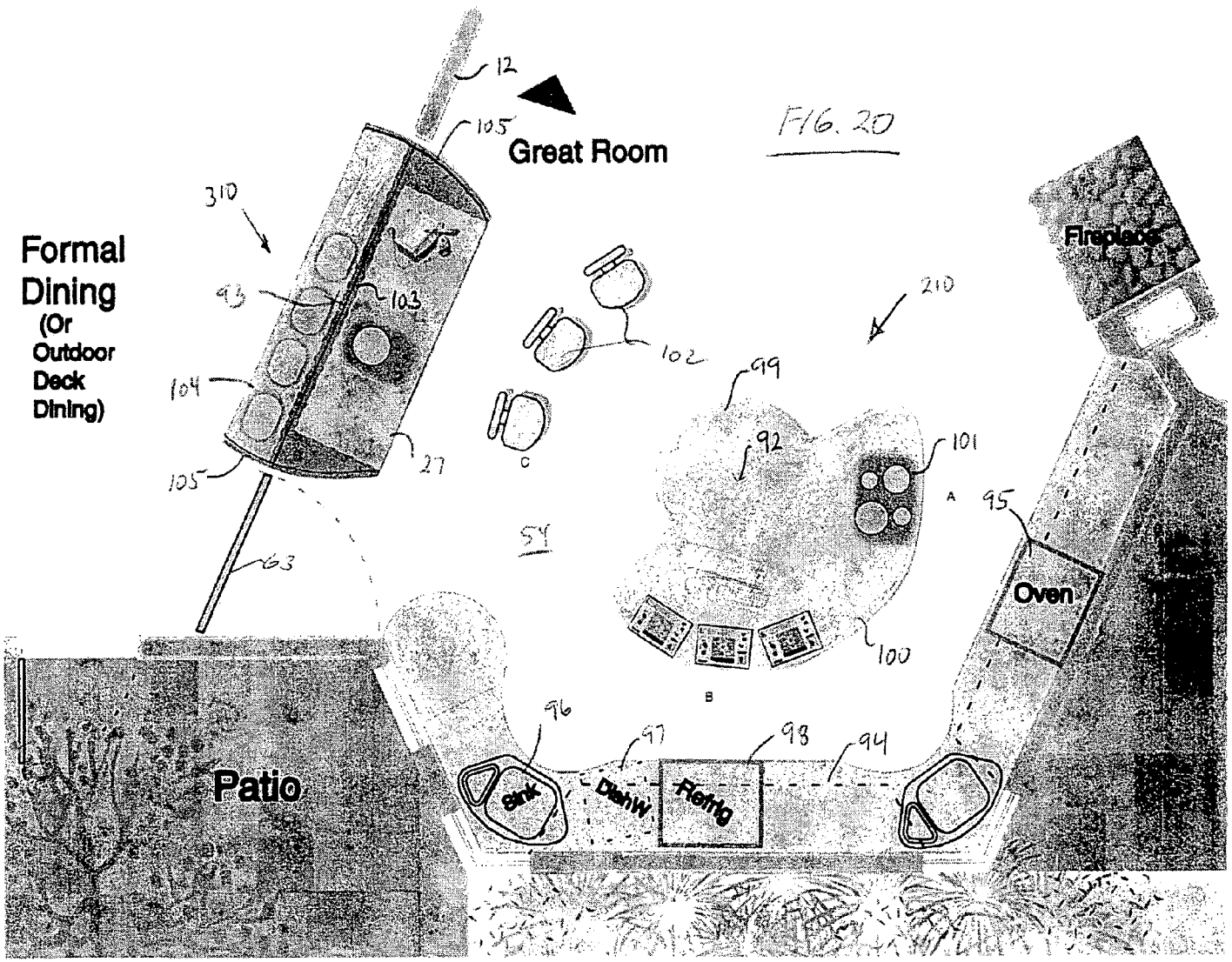
FIG. 20 is a schematic plan view diagram illustrating a further alternative preferred form of the invention, with a rotatably supported partial-height wall module such as a kitchen island, and further including a rotatably supported wall module supported for rotation on an axis disposed out-of-line with the plane of an associated building wall.
Figure 21:
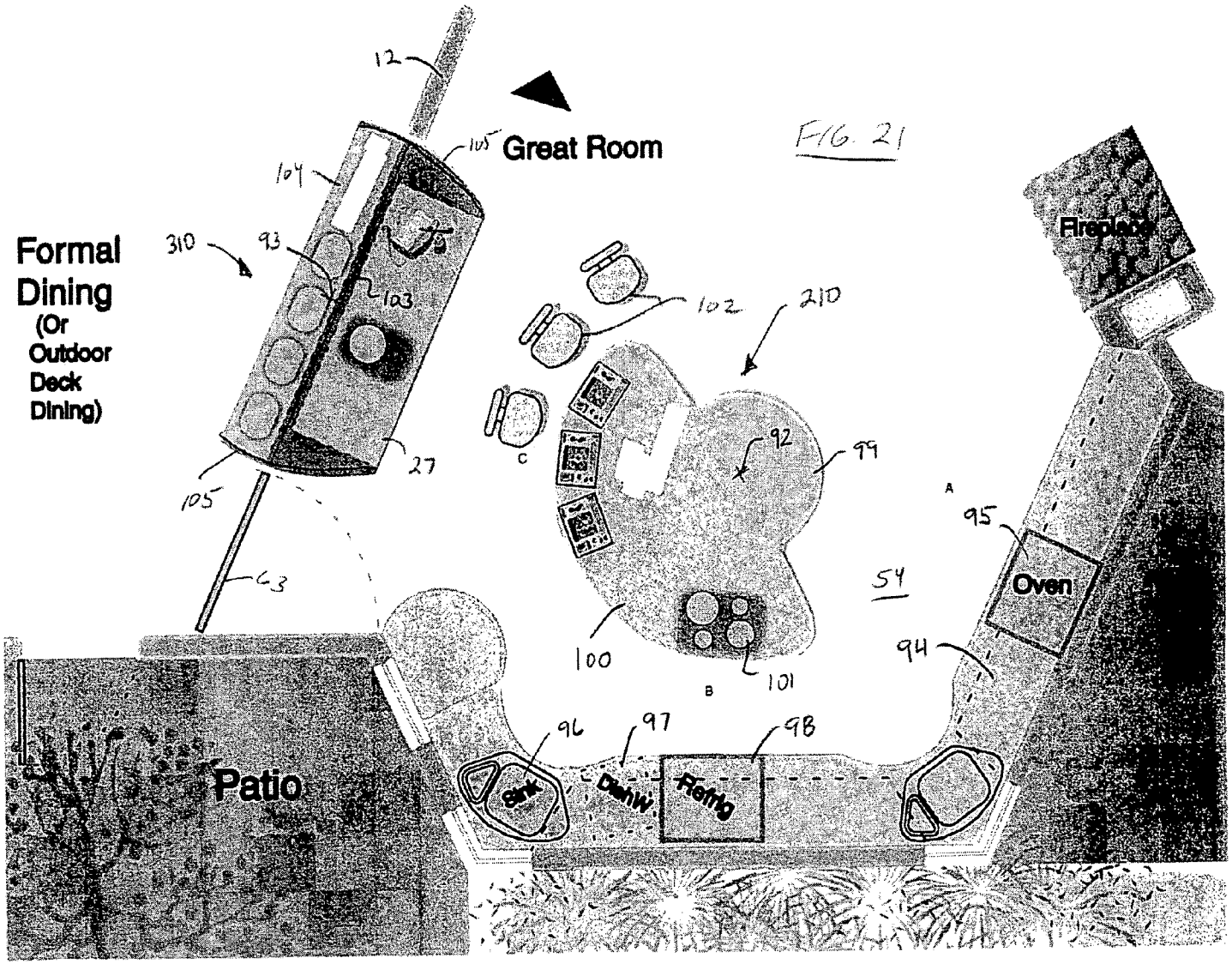
FIG. 21 is a schematic plan view diagram corresponding to FIG. 20, but showing the island module in an alternative rotational position.

FIG. 20 shows the rotatable island module 210 in a first rotary position relative to the adjoining structures in the room, with the range top 101 deployed across a relatively narrow aisle space from the oven 95. This first rotary position may be desired during a food preparation phase. FIG. 21 shows the island module 210 shifted to a second position, with the range top 101 deployed across a similar narrow aisle space from the refrigerator 98, and also positioned relatively close to the sink 96 and the dishwasher 97. This second rotary position may be desired during a post-meal clean-up phase. In both the first and second positions as shown, the larger half-circle segment 100 of the island module 210 is deployed relatively close to the stationary countertop 94 to provide increased overall available work surface area.

Figure 22:
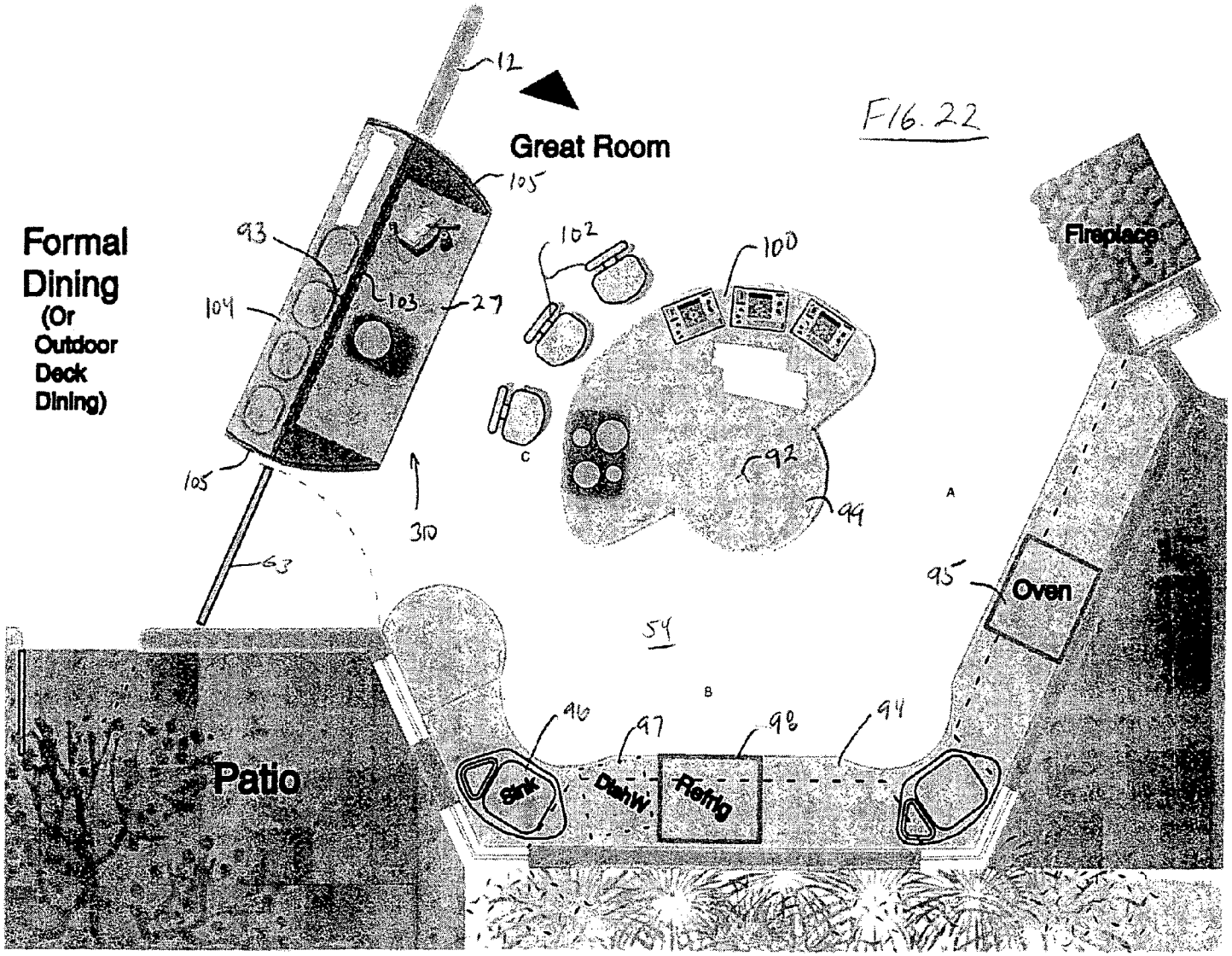
FIG. 22 is a schematic plan view diagram corresponding to FIGS. 20–21, but showing the island module is another alternative rotational position.

By contrast, FIG. 22 shows the island module 210 in an third rotary position with the larger half-circle segment 100 rotated away from the stationary countertop 94. This third position may be desired during a meal, with the larger island segment 100 positioned proximate a plurality of chairs or stools 102 upon which diners may sit. In this third position, it is noted that the spaced between the rotary island module 210 and the stationary countertop 94 is significantly increased. Accordingly, this third position is also conveniently used during a party or gathering wherein multiple persons may be present within the kitchen. This increased space is attributable to the asymmetric shape of the island module 210, namely, that the rotary axis 92 thereof is located off-center or off-axis relative to the overall fore-aft depth of the unit.

Figure 23:
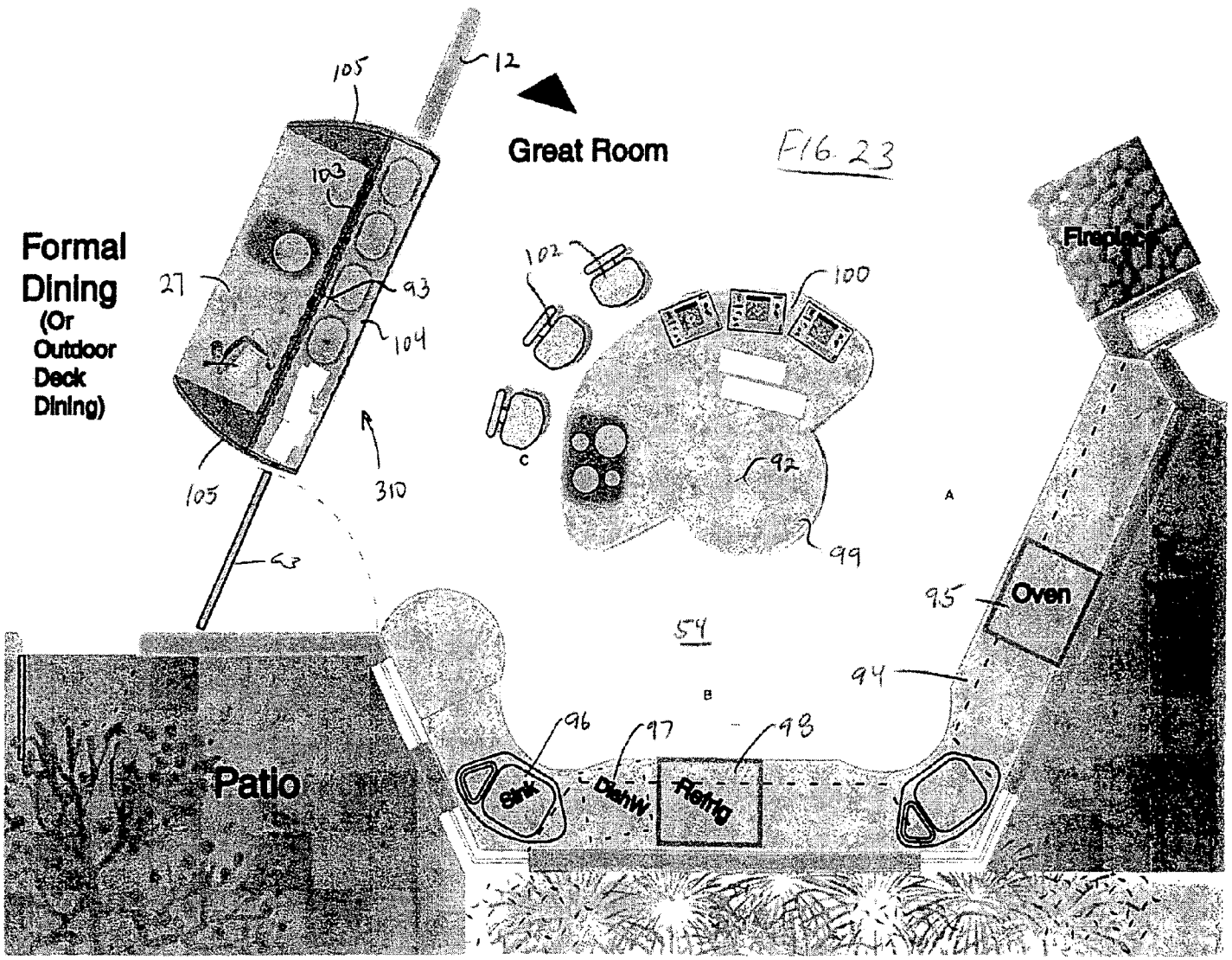
FIG. 23 is a schematic plan view diagram corresponding to FIGS. 20–22, but showing the wall module in an alternative rotational position.

FIGS. 20–23 additionally show the movable wall module 310, which may be provided separately from, or in addition to, the movable partial-height island module 210. As shown, this wall module 310 is mounted within a building wall 12 dividing the illustrative kitchen from an adjoining room or space such as a dining room or an outdoor space. The wall module 310 may be constructed generally as shown and described previously herein, to include a wall segment 103 for substantially closing the opening in the building wall 12, and components on opposite sides thereof such as a desk or other work surface 27 on one side and a diner countertop 104 on the opposite side. As shown, the wall module 310 is rotatably supported on an axis 93 disposed off-center or off-axis relative to a plane including the building wall. In this regard, the wall segment 103 of the module 310 is aligned or substantially in-plane with the building wall 12 when the wall module 310 is in a first position as viewed in FIGS. 20–22, but is a short distance out-of-line with the plane of the building wall in a second rotary position as viewed in FIG. 23. End caps 105 at the opposite ends of the wall segment 103 are desirably present for filling residual space between the wall segment 103 and the building wall 12, when the module 310 is in the second rotary position (FIG. 23).

The fore-aft depths of the components carried by the movable wall module 310 may be different, such as a larger depth for the work surface 27 versus a shorter depth for the diner countertop 104, as shown. With this construction, the rotary wall module 310 may be shifted to vary functionality relative to the adjoining spaces, and also to vary the available unoccupied space adjacent the module 310. That is, as viewed in FIGS. 20–22, the desk or work surface 27 protrudes a significant distance into the kitchen space, wherein in the reversed position depicted in FIG. 23 the shorter diner countertop 104 protrudes a shorter distance into the kitchen space. Accordingly, rotational shifting of the wall module 310 not only alters the presentation of the functional components relative to the adjoining spaces, but also alters the unoccupied floor area within those spaces. In addition, in a rotary position generally mid-way (not shown) between the first and second positions as shown, the narrower component 104 is spaced from the adjacent edge of the building wall 12 by a greater distance thereby provide an enhanced transit space through the wall 12. Alternately, or in addition, one side of the opening formed in the wall 12 may include an optional swinging or sliding door 63 as shown.

FIGS. 24–27 illustrate another alternative preferred embodiment of the invention, wherein components identical to those previously shown and described herein are identified by common reference numerals, and modified components that otherwise correspond in structure and function to those previously shown and described herein are conveniently identified by common reference numerals increased by a factor of 400. As shown, a partial-height movable wall structure such as the illustrative countertop peninsula or return segment 410 is provided for use in a kitchen environment, although it will be appreciated that alternative part-height structures for use in other usage environments may be employed. The countertop return segment 410 is rotatably supported on an axis 91 disposed off-center relative to a transverse mid-point, so that the segment 410 can be rotatably deployed in multiple different functional positions relative to adjoining structure such as a stationary kitchen countertop 94 (which may include functional items such as sink, etc. (not shown)), and adjoining rooms or other spaces such as a dining room 416 and an adjacent room or space 418 such as a living room or an outdoor patio of the like. In at least some of the multiple rotary positions, one end of the return segment 410 may abut adjoining structures such as the stationary countertop 94 (FIG. 24) or a building wall 12.

Figure 26:
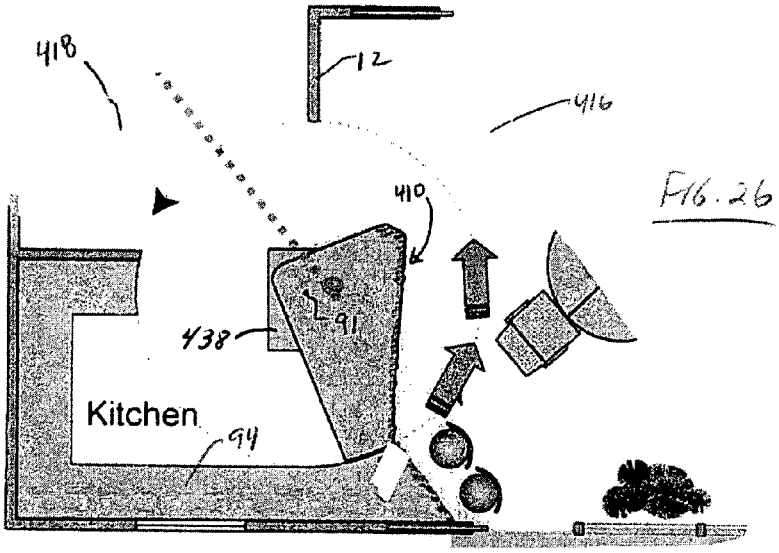
FIG. 26 is a schematic plan view diagram corresponding to FIGS. 24–25, and showing the countertop return segment in a third rotary position.
Figure 27:
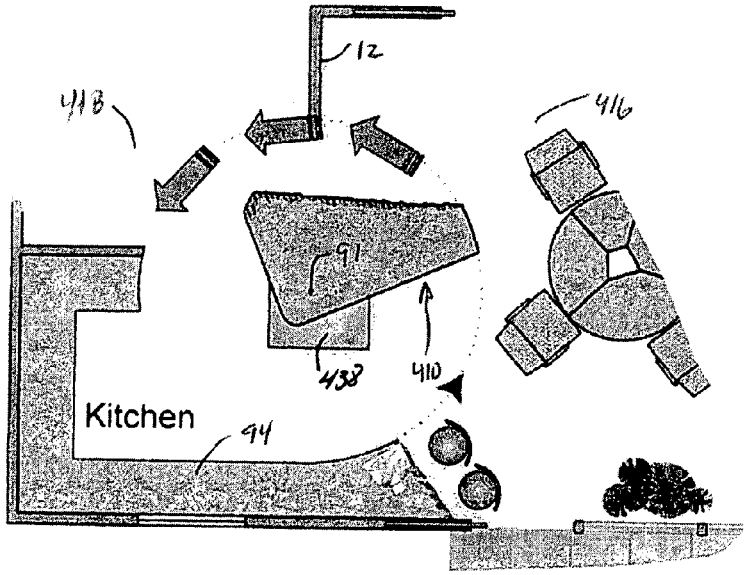
FIG. 27 is a schematic plan view diagram corresponding to FIGS. 24–26, and depicting the countertop return segment in a fourth rotary position.

More particularly, in a first rotary position as viewed in FIG. 24, the countertop return segment 410 may abut one end of the stationary countertop 94 to form a generally conventional U-shaped kitchen countertop configuration, with an open end for direct access to the dining room 416. The rotatable countertop segment 410 may be shifted to a second position as viewed in FIG. 25 to abut a building wall 12, and thereby partially close a space defined between the wall 12 and a base or bearing assembly 438 which rotatably supports the return segment 410 generally adjacent one end thereof. FIG. 26 shows a third rotary position with the return segment 410 abutting an opposite end of the stationary countertop 94, thereby reconfiguring the kitchen for alternative access directly into the other room or space 418. FIG. 27 shows a fourth rotary position with the return segment 410 extending into the dining room 416 for facilitated transfer of food and dishware products to and from dining furniture within the dining room 416.

A variety of further modifications and improvements in and to the movable wall module of the present invention will be apparent to those persons skilled in the art. For example, persons skilled in the art will recognize and appreciate that any of the various features, e.g., cable access ports, etc., disclosed with respect to any one of the embodiments shown and described herein may be employed in any one of the other embodiments shown and described herein. Accordingly, no limitation on the invention is intended by way of the foregoing description and accompanying drawings, except as set forth in the appended claims.

What is claimed is:

1. A movable wall module for installation into an opening formed in a building wall, said movable wall module comprising:

a module frame having a first side and a second side;

first component means supported on said first side of said frame;

second component means supported on said second side of said frame; and means for movably supporting said frame within the building wall opening for selectively and reversibly presenting said first and second component means respectively within rooms or spaces each including a floor and disposed at opposite sides of the building wall;

said means for movably supporting said frame comprising a bearing assembly for supporting said frame on a generally vertical axis for rotation relative to the floor of said rooms or spaces disposed at opposite sides of the building wall;

said bearing assembly supporting said frame for rotation on an axis disposed off-center relative to the opening formed in the building wall.

2. The movable wall module of claim 1 wherein at least one of said first and second component means comprises a component module mounted on said frame.

3. The movable wall module of claim 1 wherein said bearing assembly has a diametric size greater than the thickness of said frame.

4. The movable wall module of claim 3 wherein said bearing assembly has a diametric size of about 2 feet.

5. The movable wall module of claim 1 wherein said bearing assembly supports said frame for rotation on an axis positioned in off-set spaced relation relative to a plane of the building wall.

6. A movable wall module for installation into an opening formed in a building wall, said movable wall module comprising:

a module frame having a first side and a second side;

first component means supported on said first side of said frame;

second component means supported on said second side of said frame; and means for rotatably supporting said frame on a vertical axis within the building wall opening for selectively and reversibly presenting said first and second component means respectively within rooms or spaces disposed at opposite sides of the building wall;

said means for movably supporting said frame comprising a bearing assembly having a size and shape for transmitting the module load to a relatively broad floor area having a width or diametric size greater than the thickness of said frame;

said bearing assembly further defining at least one access port, and further including at least one utility service component coupled through said at least one access port to at least one of said first and second component means.

7. The movable wall module of claim 6 wherein said at least one utility service component comprises a cable.

8. The movable wall module of claim 6 further including means for limiting maximum rotational displacement of said frame.

9. The movable wall assembly of claim 6 wherein said means for movably supporting said frame comprises castor means for rolling support of said frame.

10. The movable wall module of claim 6 wherein said frame is movably supported between a reversible normal position substantially aligned with the building wall and substantially closing the building wall opening, and an open position substantially misaligned with the building wall to define at least one transit passage through said building wall opening.

11. The movable wall module of claim 10 further including acoustic seal means carried at opposite side edges of said frame for reducing acoustic transmission through the building wall opening when said frame is in said substantially closed position.

12. The movable wall module of claim 11 wherein said acoustic seal means comprises an expansible seal member for engaging the building wall when said frame is in said substantially closed position, said expansible seal member being retractable to accommodate movement of said frame to said open position.

13. The movable wall module of claim 11 wherein said acoustic seal means comprises acoustic material lining nonlinear edges formed on the opposite side edges of said frame and cooperating with generally matingly shaped nonlinear edge surfaces on the building wall when said frame is in said substantially closed position to reduce acoustic transmission through the building wall opening.

14. The movable wall module of claim 6 wherein said frame has a depth at the opposite side edges thereof which is significantly greater than the spacing between said frame side edges and the building wall edge surfaces when said frame is in the substantially closed position.

15. The movable wall module of claim 6 wherein said frame has a thickness of from about 1 foot to about 1½ feet.

16. The movable wall module of claim 6 wherein said frame thickness is substantially greater than the clearance between an upper edge of said frame and an upper edge of said building wall opening.

17. The movable wall module of claim 6 wherein said first component means comprises a home entertainment unit.

18. The movable wall module of claim 17 wherein said home entertainment unit comprises a video display mounted on a subpanel, and further including means for rotatably supporting said subpanel on said frame for reversibly presenting said display panel respectively within rooms or spaces at opposite sides of the building wall, independently of movement of said frame.

19. The movable wall module of claim 6 wherein said second component means defines a work surface.

20. The movable wall module of claim 6 wherein said frame is manually movable.

21. The movable wall module of claim 6 further including power means for moving said frame.

22. The movable wall module of claim 6 wherein said frame further includes a third side, said means for movably supporting said frame within the building wall opening being for selectively arid changeably presenting said first and second component means respectively within rooms or spaces disposed at three sides of the building wall.

23. A movable wall module, said movable wall module comprising:

a module frame having a first side and a second side;

first component means supported on said first side of said frame;

second component means supported on said second side of said frame; and means for movably supporting said frame within a building opening for selectively and reversibly presenting said first and second component means respectively within rooms or spaces disposed at opposite sides of the wall module;

said first component means being mounted on a subpanel, and further including means for rotatably supporting said subpanel on said frame for reversibly presenting said first component means respectively within rooms or spaces at opposite sides of the building wall, independently of movement of said frame.

24. A movable wall module for installation into an opening formed in a building wall, said movable wall module comprising:

a module frame having a first side and a second side;

first component means supported on said first side of said frame;

second component means supported on said second side of said frame; and means for movably supporting said frame within the building wall opening for selectively and reversibly presenting said first and second component means respectively within moms or spaces disposed at opposite sides of the building wall;

said frame having a generally truncated conical cross sectional shape defining a relatively large thickness at a lower end thereof and tapering upwardly to a narrower thickness.

25. A movable wall module for installation into an opening formed in a building wall, said movable wall module comprising:

a module frame having a first side and a second side;

first component means supported on said first side of said frame;

second component means supported on said second side of said frame; and means for movably supporting said frame within the building wall opening for selectively and reversibly presenting said first and second component means respectively within moms or spaces disposed at opposite sides of the building wall;

said first side of said frame defining a generally vertical surface, and wherein said second side of said frame defines a tapered surface extending upwardly and angularly inwardly toward said first surface.

26. A movable wall module for installation into a building, said movable wall module comprising:

a module frame defining first and second opposite sides and a fore-aft depth extending between said first and second opposite sides;

means for movably supporting said frame within the building for rotatable movement about an axis located off-center relative to the fore-aft depth of the wall module.

27. The movable wall module of claim 26 wherein said wall module is adapted to fit generally within an opening formed in a building wall, and further wherein said axis is located in laterally spaced relation to a plane of the building wall.

28. A movable wall module for installation into a building, said movable wall module comprising:

a module frame;

a first component mounted on one side of said module frame and having a first depth, and a second component mounted on an opposite side of said module frame and having a second depth, said first and second depths being unequal;

said module frame and said first and second components cooperatively defining an overall fore-aft depth; and means for movably supporting said frame within the building for rotatable movement about an axis located off-center relative to the overall fore-aft depth of the wall module.

29. The movable wall module of claim 26 wherein said wall module comprises a partial-height module structure.

30. A movable wall module for installation into a building, said movable wall module comprising:

a module frame; and mounting means for movably supporting said frame within the building for rotatable movement about an axis located off-center relative to a transverse width of said wall module;

said mounting means movably supporting said frame for movement to at least one position with one end of said wall module in substantially abutting relation with a building wall.

31. A movable wall module for installation into a building, said movable wall module comprising:

a module frame adapted to fit generally within an opening farmed in a building wall; and means for movably supporting said frame within the building for rotatable movement about an axis located in laterally spaced relation to a plane of the building wall.

32. A movable wall module for installation into an opening formed in a wall of a building wherein the building wall separates first and second spaces each including a stationary floor disposed respectively at opposite sides of the building wall, said movable wall module comprising:

a generally upright module frame having generally vertically extending first and second sides;

first component means supported on said first side of said frame;

second component means supported on said second side of said frame;

said first and second sides of said module frame each extending upwardly from a lower margin disposed directly adjacent the stationary floor of said first and second spaces, in the absence of an intervening turntable floor segment on said frame, whereby said first and second component means supported on said frame are disposed in direct overlying relation to the stationary floor of said first and second spaces; and means for movably supporting said frame within the building wall opening for movement between a first position with said first and second component means presented respectively to said first and second spaces, and a second position with said first and second component means presented respectively to said second and first spaces;

wherein said means for movably supporting said frame supports said frame for rotation on a generally vertical axis positioned in off-set spaced relation relative to a plane of the building wall; and further wherein the stationary floor area within said first and second spaces is substantially exposed and unobstructed by said frame, when said frame is in either one of said first and second positions.

33. The movable wall module of claim 32 wherein said means for movably supporting said frame comprises a bearing assembly having a size and shape for transmitting the module load to a relatively broad floor area having a width or diametric size greater than the thickness of said frame.

34. The movable wall module of claim 32 wherein said means for movably supporting said frame comprises a bearing assembly having at least one utility service component coupled through said at least one access port formed therein to at least one of said first and second component means.

35. A movable wall module for installation into an opening formed in a wall of a building wherein the building wall separates first and second spaces each including a stationary floor disposed respectively at opposite sides of the building wall, said movable wall module comprising:

a generally upright module frame having generally vertically extending first and second sides;

first component means supported on said first side of said frame;

second component means supported on said second side of said frame;

said first and second sides of said module frame each extending upwardly from a lower margin disposed directly adjacent the stationary floor of said first and second spaces, in the absence of an intervening turntable floor segment on said frame, whereby said first and second component means supported on said frame are disposed in direct overlying relation to the stationary floor of said first and second spaces; and means for movably supporting said frame within the building wall opening for movement between a first position with said first and second component means presented respectively to said first and second spaces, and a second position with said first and second component means presented respectively to said second end first spaces;

wherein said means for movably supporting said frame supports said frame for rotation on a generally vertical axis located off-center relative to the overall fore-aft depth of the wall module; and further wherein the stationary floor area within said first and second spaces is substantially exposed and unobstructed by said frame, when said frame is in either one of said first and second positions.

36. The movable wall module of claim 32 wherein said first component means has a first depth and a said second component means has a second depth, said first and second depths being unequal.

* * * * *